US005650795A

United States Patent [19]

Banno et al.

[11] Patent Number: 5,650,795

[45] Date of Patent: Jul. 22, 1997

[54] ELECTRON SOURCE AND MANUFACTURE METHOD OF SAME, AND IMAGE FORMING DEVICE AND MANUFACTURE METHOD OF SAME

[75] Inventors: Yoshikazu Banno, Ebina; Seishiro Yoshioka, Hiratsuka; Ichiro Nomura; Hidetoshi Suzuki, both of Atsugi; Tetsuya Kaneko, Yokohama; Toshihiko Takeda, Atsugi, all of Japan

[73] Assignee: Canon Kabushiki Kaisha, Tokyo, Japan

[21] Appl. No.: 172,105

[22] Filed: Dec. 23, 1993

[30] Foreign Application Priority Data

Dec. 28, 1992 [JP] Japan ..... 4-347819
Dec. 28, 1992 [JP] Japan ..... 4-347868

[51] Int. Cl.[6] ..... G09G 3/22

[52] U.S. Cl. ..... 345/74; 313/309; 315/118

[58] Field of Search ..... 345/74; 313/308, 313/309, 310, 336, 346 R; 315/1, 366, 118

[56] References Cited

U.S. PATENT DOCUMENTS 4,599,847 7/1986 Reenstra .
4,954,744 9/1990 Suzuki et al. ..... 313/336
5,164,851 11/1992 Kanemori et al. .
5,285,129 2/1994 Takeda et al. .

*Primary Examiner*—Regina D. Liang
*Attorney, Agent, or Firm*—Fitzpatrick, Cella, Harper & Scinto

[57] ABSTRACT

In an electron source comprising a base plate and an electron emitting element disposed on the base plate, the electron emitting element includes a plurality of electron emitting portions electrically connected in parallel, the electrical connection being made through a thermally cut-off member. After forming the plurality of electron emitting portions, their electron emission characteristics are checked and, for that electron emitting portion on which the electron emission characteristic has been found not normal, the electrical connection is cut off. Alternatively, the electron emitting element includes an electron emitting portion connected to a voltage supply through a thermally cut-off member, and an electron emitting portion forming film which includes a thermally connecting member. In this case, after cutting off the electrical connection in that electron emitting portion on which the electron emission characteristic has been found not normal, the electron emitting portion forming film is connected to the voltage supply for forming another electron emitting portion in the film. With such an electron source and an image forming device using the electron source, a production yield and image quality are improved.

31 Claims, 19 Drawing Sheets

ELECTRON SOURCE AND MANUFACTURE METHOD OF SAME, AND IMAGE FORMING DEVICE AND MANUFACTURE METHOD OF SAME

BACKGROUND OF THE INVENTION

1. Field of the Invention

The present invention relates to an electron source for emitting an electron beam and a manufacture method of the electron source, as well as an image forming device such as a display for forming an image by irradiation of an electron beam and a manufacture method of the image forming device.

2. Related Background Art

Known hitherto are two kinds of electron emitting elements, i.e., a thermo-electron source and a cold cathode electron source. As a cold cathode electron source, there are electron emitting elements of field emission type (hereinafter abbreviated as FE), metal/insulating layer/metal type (hereinafter abbreviated as MIM), and surface conduction type.

Known as examples of FE are W. P. Dyke & W. W. Dolan, "Fieldemission", Advance in Electron Physics, 8, 89 (1956), C. A. Spindt, "Physical Properties of thin-film field emission cathodes with Molybdenium cones", J. Appl. Phys., 47, 5428 (1976), etc.

Known as examples of MIM are C. A. Mead, "The tunnel-emission amplifier", J. Appl. Phys., 32, 646 (1961), etc.

Known as examples of an electron emitting element of surface conduction type are M. I. Elinson, Radio Eng. Electron Phys., 10 (1965), etc.

Here, the term "electron emitting element of surface conduction type" means an element which utilizes a phenomenon of causing electron emission when a thin film of small area is formed on a base plate (substrate) and a current is supplied to flow parallel to the film surface. As electron emitting elements of surface conduction type, in addition to the above-cited element by Elinson using an $SnO_2$ thin film, there have been reported an element using an Au thin film [G. Dittmer: "Thin Solid Films", 9,317 (1972)], an element using an $In_2O_3/SnO_2$ thin film [M. Hartwell and C. G. Fonstad: "IEEE Trans. ED Conf.", 519 (1975)], an element using a carbon thin film [Hisashi Araki et. al.: "Vacuum", Vol. 26, No. 1, p. 22 (1983)], etc.

As a typical element configuration of those electron emitting elements of surface conduction type, FIG. 28 shows a configuration of the above element reported by M. Hartwell, et. al. In FIG. 28, denoted by 231 is an insulating base plate and 232 is an electron emitting portion forming thin film which is of a thin film of metal oxide or the like formed by sputtering into a H-shaped pattern. An electron emitting portion 233 is formed by an electrifying process called 'forming' described later. 234 is referred to as an electron emitting portion including thin film.

In such an electron emitting element of surface conduction type, it has conventionally been generally known to form the electron emitting portion forming thin film 232 into the electron emitting portion 233 beforehand by an electrifying process called 'forming' prior to start of electron emission. The term 'forming' means a process of by applying a voltage across the electron emitting portion forming thin film 232 to effect an electrifying process so that the electron emitting portion forming thin film is locally broken, deformed or denatured, thereby forming the electron emitting portion 233 which is caused to have an electrically high-resistance state. With the electron emitting element of surface conduction type thus subjected to the 'forming' process, electrons are emitted from the electron emitting portion 233 by applying a voltage to the electron emitting portion including thin film 234 and flowing a current through the element.

However, the above prior art electron emitting elements of surface conduction type have accompanied various problems in realizing practical use. Therefore, the applicant has conducted intensive studies aiming at various improvements and has solved the problems in practical use as follows.

For example, the applicant has proposed a novel electron emitting element of surface conduction type that, as shown in FIG. 27, a fine particle film 244 is arranged as the electron emitting portion forming thin film between electrodes 242 and 243 on a base plate 241, and the fine particle film 244 is subjected to the electrifying process to form an electron emitting portion 245 (Japanese Patent Application Laid-Open No. 2-56822).

As an example in which numerous electron emitting elements of surface conduction type are formed in an array, there have been proposed an electron source having a number of rows in each of which electron emitting elements of surface conduction type are arrayed in parallel and these individual elements are interconnected at their both ends by wires (e.g., Japanese Patent Application Laid-Open No. 64-31332 filed by the applicant).

Meanwhile, particularly in the field of image sensing devices including displays, flat type displays using liquid crystals have recently been employed in place of CRT's. But liquid crystal displays are not emission type and hence have had such a problem as requiring backlights or the like. For this reason, displays of emissive type have been demanded.

In order to satisfy such a demand, a display in combination of an electron source which comprises an array of numerous electron emitting elements of surface conduction type, and a fluorescent material which emanates a visible light upon impingement of electrons emitted from the electron source has been proposed as an image forming device (e.g., U.S. Pat. No. 5,066,883 assigned to the applicant). This is an emissive type display which enables even a large-screen device to be relatively easily manufactured, and which is superior in display quality.

In a variety of image forming devices including the above-mentioned display, a larger screen size and higher fineness are inevitably demanded and expected. However, for an electron source in which numerous electron emitting elements are formed into an array as mentioned above, the following problems, for example, may be caused due to troubles particularly encountered in manufacture:

1) defect or failure of electron emitting elements themselves,
2) disconnection of common wires or short circuit between adjacent wires, and
3) failure of interlayer insulation in areas where common wires cross each other.

SUMMARY OF THE INVENTION

An object of the present invention is to deal with the aforesaid problems occurring in an electron source, in which numerous electron emitting elements are formed into an array, due to troubles encountered in manufacture, especially a defect or failure of electron emitting element themselves, and to remarkably improve a production yield of electron sources and image forming devices.

Also, an object of the present invention is to provide an electron source and a manufacture method of the same, and an image forming device and a manufacture method of the same, by which a defect or failure of electron emitting element themselves can be coped with sufficiently, and deterioration of image quality such as pixel defects and uneven brightness occurring when images are displayed is very small.

Further, the present invention is concerned with an electron source comprising numerous electron emitting elements, particularly electron emitting elements of surface conduction type, formed into an array, and an image forming device using such an electron source, and its object is to increase a production yield and improve deterioration of image quality.

According to an aspect of the present invention, there is provided an electron source comprising a base plate and an electron emitting element disposed on the base plate, wherein:

the electron emitting element includes a plurality of electron emitting portions electrically connected in parallel, the electrical connection being made through a thermally cut-off member.

According to another aspect of the present invention, there is provided a manufacture method for an electron source comprising a base plate and an electron emitting element disposed on the base plate, comprising the steps of:

forming a pluraltiy of electron emitting portions electrically connected in parallel on the base plate, checking the plurality of electron emitting portions to detect electron emission characteristics, and cutting off the electrical connection in that electron emitting portion on which the electron emission characteristic has been found not normal as a result of the checking step.

According to still another aspect of the present invention, there is provided an electron source comprising a base plate and an electron emitting element disposed on the base plate, wherein:

the electron emitting element includes an electron emitting portion connected to voltage supply means through a thermally cut-off member, and an electron emitting portion forming film which includes a thermally connecting member.

According to still another aspect of the present invention, there is provided a manufacture method for an electron source comprising a base plate and an electron emitting element disposed on the base plate, comprising the steps of:

forming an electron emitting portion connected to voltage supply means, and an electron emitting portion forming film on the base plate, checking the electron emitting portion to detect an electron emission characteristics, and cutting off the connection in that electron emitting portion on which the electron emission characteristic has been found not normal as a result of the checking step, connecting the electron emitting portion forming film to the voltage supply means, and forming an electron emitting portion in the electron emitting portion forming film.

According to still another aspect of the present invention, there is provided an electron source comprising a base plate and an electron emitting element disposed on said base plate, wherein:

said electron emitting element includes an electron emitting portion connected to voltage supply means, the connection being performed by using a thermally connecting member.

According to still another aspect of the present invention, there is provided an image forming device comprising any of the above electron sources, an image forming member for producing an image upon irradiation of electron beams emitted from the electron source, and modulation means for modulating the electron beam irradiated to the image forming member in accordance with an input image signal.

DESCRIPTION OF THE PREFERRED EMBODIMENTS

Of the above-mentioned troubles possibly occurred in manufacture of an electron source and an image forming device in which numerous electron emitting elements are formed into an array, a defect or failure of electron emitting elements may appear as follows:

a) electrical short circuit (defect), b) electrical disconnection (defect), and c) unsatisfactory characteristic of electron emission (failure).

As a result of conducting intensive studies on such defects or failures of electron emitting elements, the inventors have discovered the following interesting finding about electron emitting elements, especially electron emitting elements of surface conduction type (often referred to simply as "surface conduction electron emitting elements"). The discovered finding will be described with reference to FIGS. 26A to 26F.

FIGS. 26A to 26F are plan views looking from above at a base plate on which an electron emitting element of surface conduction type is provided, and showing a state before a 'forming' process which is to be made to form an electron emitting portion.

Figure 26A:
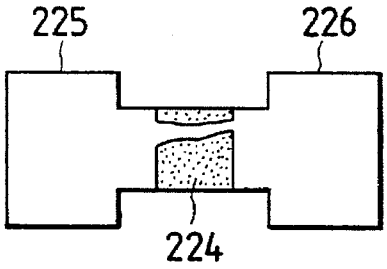
FIGS. 26A to 26F are plan views showing examples of a defect or failure occurred in the electron emitting element of surface conduction type.

First, an electric short circuit possibly occurred in the electron emitting element of surface conduction type is caused upon a conductive substance bridging between element electrodes 225 and 226, for example, as shown in FIG. 26A. If such a bridge is produced, it is a natural result that a voltage cannot effectively be applied to an electron emitting portion forming thin film 224 and the 'forming' process (i.e., electrifying process for the electron emitting portion forming thin film 224) or actual driving cannot be effected.

The above bridge is mainly attributable to the fact that proper etching has not been carried out owing to dust deposited on a photoresist or local unevenness of etchant density, for example, when the element electrodes 225, 226 are formed by photolithography etching. As another case, when an electrode pattern is formed by lift-off, the bridge may be produced if washing after the lift-off is not sufficient and a peeled flake is left in such a state as to straddle both the element electrodes 225, 226.

Figure 26B:
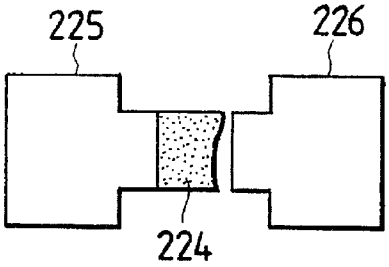
Figure 26C:
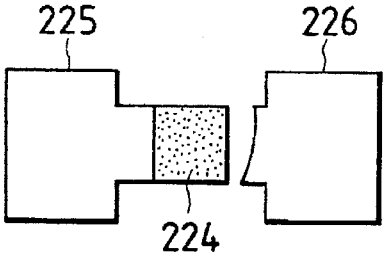

Then, an electrical disconnection possibly occurred in the electron emitting element of surface conduction type is caused when an electrical connection between the element electrodes 225, 226, including the electron emitting portion forming thin film 224 formed therebetween, is cut off at any location, for example, as shown in FIGS. 26B and 26C. If such a disconnection occurs, it is also a natural result that a voltage cannot effectively be applied to the electron emitting portion forming thin film 224 and the 'forming' process or actual driving cannot be effected.

The electrical disconnection as shown in FIG. 26B is often caused upon such an occasion, for example, that a mask pattern is shifted in its position during a step of forming the electron emitting portion forming thin film 224, or the electron emitting portion forming thin film 224 is partly peeled off after the formation thereof.

Also, the electrical disconnection as shown in FIG. 26C is often caused upon such an occasion, for example, that the element electrodes 225, 226 include defects developed in their film forming, or they are partly peeled off after the film forming.

Figure 26D:
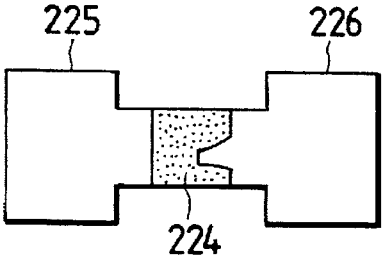
Figure 26E:
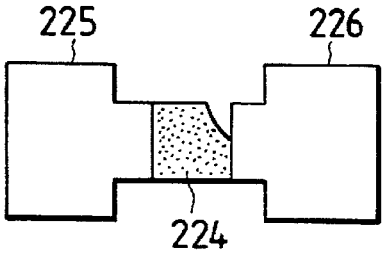
Figure 26F:
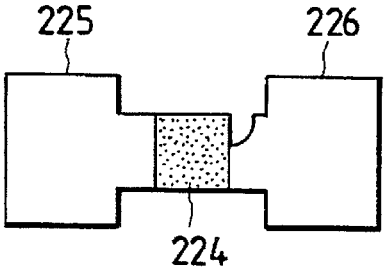

An unsatisfactory characteristic of electron emission possibly occurred in the electron emitting element of surface conduction type is caused when the above electrical short circuit or disconnection happens to such an extent as not to lead to a fatal defect as shown in FIGS. 26D to 26F. In this case, since a voltage or an electric field or electric energy effectively applied to the electron emitting portion forming thin film 224 deviates from a preset design value, application of the voltage in the 'forming' process or actual driving cannot be effected as intended, which remarkably reduce an emitted current (i.e., an output electron beam).

The present invention has been made principally based on the finding explained above. Hereinafter, preferred embodiments of the present invention will be described in detail.

The inventors have solved the above-mentioned problems in an electron source and an image forming device each including electron emitting elements, especially electron emitting elements of surface conduction type, by using two means presented below.

With the first means of the present invention, a plurality of electron emitting portion forming thin films are provided in parallel electrically beforehand on each electron emitting element of surface conduction type, and electron emitting portions are formed by carrying out an electrification 'forming'. Characteristics of the formed electron emitting portions are then checked. Those electron emitting portions which have good characteristics are used as they are, but for those electron emitting portions on which unsatisfactory characteristics or defects have been found, the electrical connection is cut off completely. The number of the electron emitting portions having good characteristics for each electron emitting element is stored in a memory, and a drive signal is modified based on data read out of the memory when the electron emitting element is driven.

Thus, with the first means of the present invention, the probability of causing complete element defects can be made very small by providing a plurality of electron emitting portion forming thin films for each element. In addition, since the driving is modified depending on the number of good electron emitting portions, variations in output of electron beams for the electron emitting elements can also be made very small.

With the second means of the present invention an electron emitting portion forming thin film electrically connected to wiring electrodes beforehand and an electron emitting portion forming thin film not yet electrically connected to wiring electrodes are both provided on each electron emitting element of surface conduction type, the former thin film being subjected to the electrification 'forming'. A characteristic of the electron emitting portion formed by the electrification 'forming' is then checked. When the characteristic is good, that the electron emitting portion is used as it is. However, if an unsatisfactory characteristic or defect is found, the electrical connection between that electron emitting portion and the wiring electrodes is cut off completely. Thereafter, the spare electron emitting portion forming thin film not yet electrically connected is now connected to the wiring electrodes and then subjected to the electrification 'forming'.

Thus, with the second means of the present invention, even if the electron emitting portion first subjected to the electrification 'forming' is found as having a drawback, it can be replaced by the spare electron emitting portion forming thin film and, therefore, a production yield of electron emitting elements of surface conduction type can drastically be improved.

The spare electron emitting portion forming thin film is not necessary the same in shape as the electron emitting portion forming thin film electrically connected beforehand. In view of spatial restrictions, the spare electron emitting portion forming thin film may be formed to have a smaller size. In this case, driving modification means is provided for modifying a difference in the electron emission characteristic due to different sizes or shapes. By providing such means, an electron beam can be produced substantially at the same output in the case of using the spare electron emitting portion forming thin film as well.

The above-mentioned two means of the present invention may be practiced solely or in combination of the both.

The present invention is preferably applicable to, in particular, electron emitting elements of surface conduction type. It has been proved that the present invention is extremely effective when applied to elements having electron emitting portions below. An electron emitting portion in an electron emitting portion including thin film is formed by conductive fine particles of which grain size is several tens angstroms, and the remaining electron emitting portion including thin film is formed of a fine particle film. The term "fine particle film" used herein means a film which is formed as an aggregation of many fine particles, and of which fine structure includes not only a condition where individual fine particles are dispersedly arranged, but also a condition where fine particles are adjacent to or overlapped with each other (including insular aggregations).

In other cases, the electron emitting portion including thin film may be a carbon thin film or the like dispersed with conductive fine particles.

The electron emitting portion including thin film is practically formed of, for example, any of metals such as Pd, Ru, Ag, Au, Ti, In, Cu, Cr, Fe, Zn, Sn, Ta, W, Nb, Mo, Rh, Hf, Re, Ir, Pt, Al, Co, Ni, Cs, Ba and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, and WC, nitride such as TiN, ZrN and HfN, semiconductors such as Si and Ge, as well as carbon and the like.

The electron emitting portion including thin film is formed by any of such methods as vacuum evaporation, sputtering, chemical vapor deposition, dispersion coating, dipping, and spinning.

The present invention will be described below in more detail in connection with embodiments.

(Embodiments)

To begin with, a first aspect of the present invention will be described with reference to FIGS. 1 to 16.

According to the first aspect of the present invention, an electron source is basically arranged such that at least a plurality of electron emitting portion forming thin films are provided in parallel electrically for each electron emitting element, and electron emitting portions are formed in these thin films. In the case of an electron emitting element of surface conduction type, for example, the electron emitting portions are formed respectively in the electron emitting portion forming thin films by carrying out an electrification 'forming'. Characteristics of the formed electron emitting portions are then checked. For those electron emitting portions which exhibit unsatisfactory characteristics, the electrical connection is cut off completely to disable application of a drive signal. Further, a drive signal is modified in accordance with the number of good electron emitting portions in each element.

(Embodiment 1)

Figure 1:
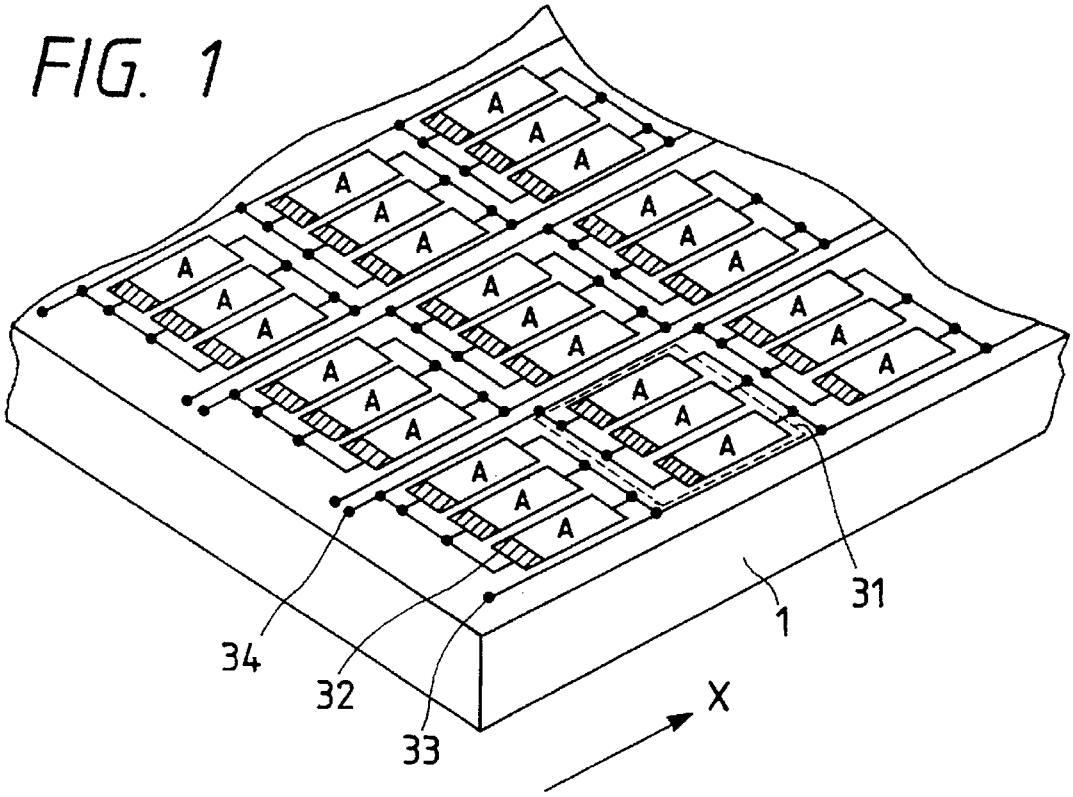
FIG. 1 is a schematic view for explaining an embodiment of an electron source according to a first aspect of the present invention.

FIG. 1 is a schematic view showing one embodiment of an electron source according to the first aspect of the present invention. In FIG. 1, a reference numeral 1 denotes a base plate (substrate) and an area 31 defined by dotted lines schematically represents one of numerous electron emitting elements of surface conduction type which are formed on the base plate 1. Only a group of nine those numerous elements are illustrated in FIG. 1.

Each electron emitting element of surface conduction type includes, as constituent members, three portions indicated by A in FIG. 1 (hereinafter referred to as portions A) and three portions indicated by hatched areas 32 (hereinafter referred to as thermally cut-off portions). More specifically, the portion A represents an electron emitting portion and surroundings thereof, and the thermally cut-off portion 32 represents a member which has good conductivity at the room temperature, but which is changed into an electrically insulated state by being molten or oxidized when heated. Note that the portion A and the thermally cut-off portion 32 illustrated in adjacent relation schematically indicate that both the members are electrically connected in series, and these two members are not always spatially adjacent to each other.

As shown in FIG. 1, one electron emitting element of surface conduction type comprises total three sets of the portions A and the thermally cut-off portions 32 which are electrically connected in series in each set, the three sets being electrically connected in parallel. Also, 33 and 34 schematically represent common wires for electrically connecting the electron emitting elements of surface conduction type in parallel which are arrayed in the X direction.

The electron emitting element 31 of surface conduction type will now be described in more detail.

Figure 2:
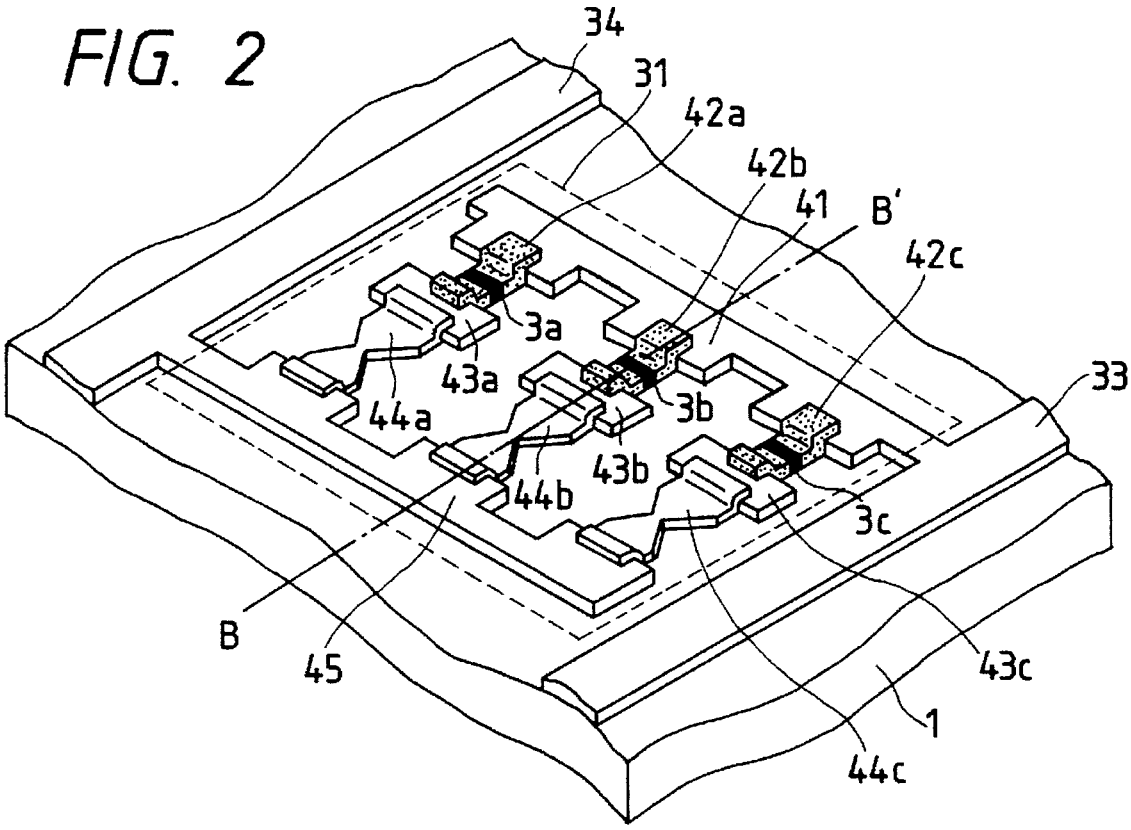
FIG. 2 is a perspective view showing a practical configuration of an electron emitting element of surface conduction type used in the embodiment of the electron source according to the first aspect of the present invention.

FIG. 2 is a perspective view for explaining a structure of the electron emitting element of surface conduction type. In FIG. 2, denoted by 1 is a base plate formed of soda lime glass, for example, and 33, 34 are common wiring electrodes made of Ni, for example. An area 31 defined by dotted lines corresponds to one electron emitting element of surface conduction type. Also, 41, 43*a*, 43*b*, 43*c* and 45 are electrodes made of Ni, for example. Electron emitting portion forming thin films 42*a*, 42*b*, 42*c* are provided respectively between the electrode 41 and the electrodes 43*a*, 43*b*, 43*c*. Further, electron emitting portions 3*a*, 3*b*, 3*c* are formed respectively in the electron emitting portion forming thin films 42*a*, 42*b*, 42*c* by an electrification 'forming' described later.

The portion A shown in FIG. 1 corresponds to a portion in FIG. 2 constituted by, for example, the electron emitting portion forming thin film 42*a*, the electron emitting portion 3*a*, the electrode 43*a*, and a part of the electrode 41. On the other hand, thin films 44*a*, 44*b*, 44*c* made of $In_2O_3$, for example, are provided respectively between the electrode 45 and the electrodes 43*a*, 43*b*, 43*c* in FIG. 2, these thin films 44*a*, 44*b*, 44*c* corresponding to the thermally cut-off portions 32 in FIG. 1.

The thin films used to form the thermally cut-off portions are preferably made of such material as above-cited $In_2O_3$, for example, which has good conductivity at the room temperature, but which is easily evaporated, molten or deformed when heated. Depending on cases, ITO on the like may be used in place of $In_2O_3$. Alternatively, such material as Al, for example, which has good conductivity at the room temperature, but which is easily oxidized to provide a very high electrical resistance when heated.

In the electron emitting element of surface conduction type described above, a drive voltage is applied to the electron emitting portions 3*a*, 3*b*, 3*c* through the common wiring electrodes 33, 34 for emanating electron beams from the electron emitting portions.

A method of manufacturing the electron emitting element of surface conduction type shown in FIG. 2 will be described below in detail.

FIGS. 3A to 3H are views for explaining steps of manufacturing the electron emitting element of surface conduction type, each figure showing a section of the base plate taken along line B–B' in FIG. 2. Note that, for convenience of illustration, FIGS. 3A to 3H are all drawn on an arbitrary reduction scale.

(Step-1)

Figure 3A:
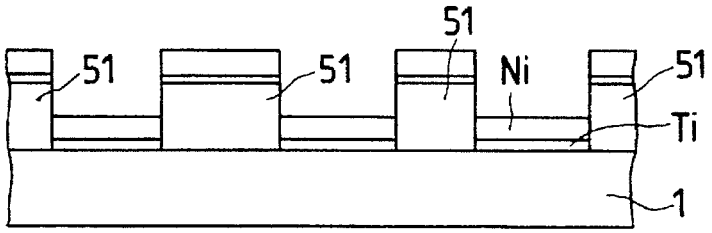
FIGS. 3A to 3H are views of successive steps for explaining a method of manufacturing the electron emitting element of surface conduction type shown in FIG. 2.

On the base plate 1 of soda lime glass sufficiently cleaned with pure water, a detergent and an organic solvent, a pattern 51 was formed by using a photoresist (RD-2000N-41, by Hitachi Chemical, Co., Ltd.). Thereafter, 50-angstrom thick Ti and 1000-angstrom thick Ni were successively laminated by vacuum evaporation (FIG. 3A).

[Step-2]

Figure 3B:
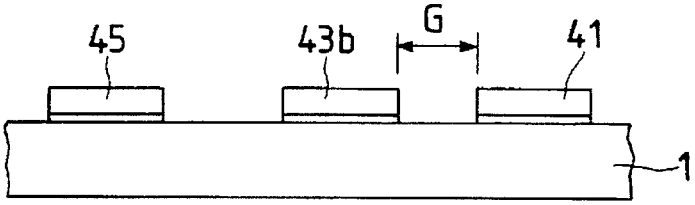

Then, the photoresist pattern 51 was dissolved with an organic solvent to partially remove the Ni/Ti deposited film by liftoff, thereby forming the electrodes 41, 43*b*, 45 each made of Ni/Ti. In this embodiment, a gap G between the electrodes 41 and 43*b* was set to 2 microns (FIG. 3B).

[Step-3]

Figure 3C:
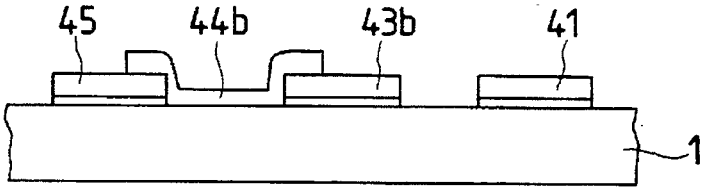

Between the electrodes 43*b* and 45, an $In_2O_3$ film 44*b* was formed in thickness of 1000 angstroms by vacuum film forming and photolithography (FIG. 3C).

[Step-4]

Figure 3D:
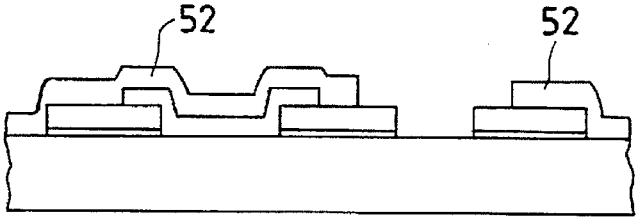

A mask pattern 52 for producing the electron emitting portion forming thin film was formed as a Cr film being 1000 angstroms thick and deposited by vacuum evaporation (FIG. 3D).

[Step-5]

Figure 3E:
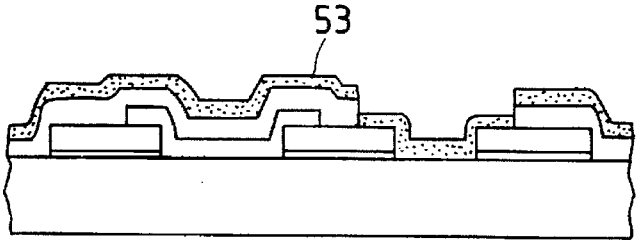

With the base plate being rotated by a spinner, an organic Pd solution (CCP4230, by Okuno Pharmaceutical Co., Ltd.) was coated over the base plate and then baked, thereby forming a thin film 53 of Pd fine particles (FIG. 3E).

(Step-6)

Figure 3F:
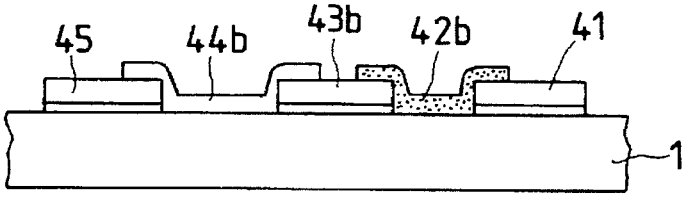

The Cr film was subjected to wet etching with an acid etchant to selectively remove a lamination of the thin film 53 and the Cr deposited film by liftoff, whereby the electron emitting portion forming thin film 42*b* was produced (FIG. 3F).

(Step-7)

Figure 3G:
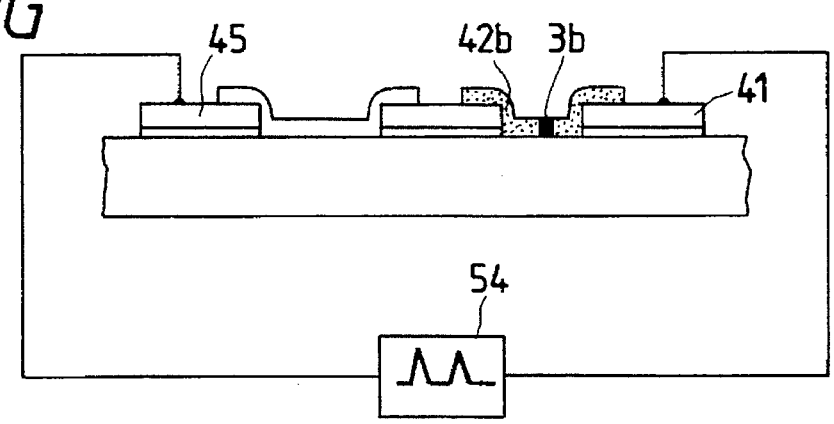

The electron emitting portion forming thin film 42*b* was then subjected to an electrification 'forming'. More specifically, a predetermined 'forming' voltage was supplied between the electrodes 41 and 45 by a 'forming' power supply 54, causing a current to flow through the electron emitting portion forming thin film 42, whereby the electron emitting portion 3*b* was formed. By the electrification 'forming', the electron emitting portions 3*a*, 3*c* were also formed respectively in the electron emitting portion forming thin films 42*a*, 42*c* at the same time (FIG. 3G).

Figure 4:
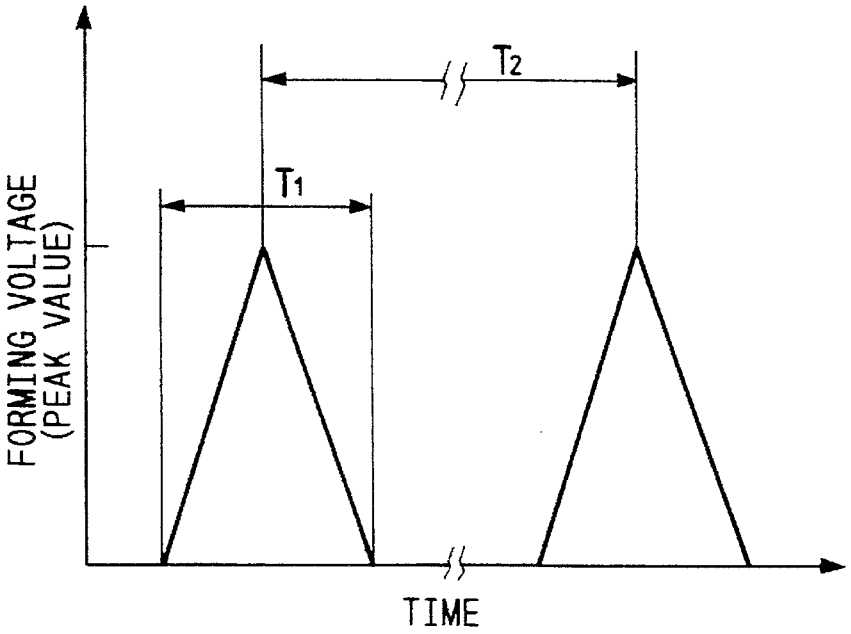
FIG. 4 is a chart showing one example of a voltage waveform applied to carry out an electrification 'forming' in the manufacture step for the electron emitting element of surface conduction type.

FIG. 4 shows one example of the predetermined 'forming' voltage.

The 'forming' voltage is given as triangular wave pulses with T1 of 1 millisecond, T2 of 10 milliseconds, and a peak voltage of 5 [V]. The pulses having such a waveform were applied for 60 seconds under a vacuum atmosphere of $1\times10^{-6}$ [Torr]. In this way, the electron emitting portion 3*b* is formed in a part of the electron emitting portion forming thin film 42*b* under a condition that fine particles each containing a palladium element as a main ingredient are dispersedly arranged in the electron emitting portion 3*b*. A mean grain size of the fine particles was 30 angstroms.

Note that the 'forming' voltage is not limited to the aforesaid waveform, but it may have any suitable other waveform such as a rectangular waveform, for example. Also, a peak value, pulse width, pulse interval, etc. of the 'forming' voltage are not necessarily limited to the above-cited values, but may have any suitable values so long as the electron emitting portion is formed successfully.

(Step-8)

The electron emitting element 31 of surface conduction type shown in FIG. 2 was fabricated through the foregoing steps. However, because the electron emitting portions are not always formed successfully in all the electron emitting portion forming thin films as suggested relating to the Related Background Art, a characteristic of electron emission was then checked.

Figure 5:
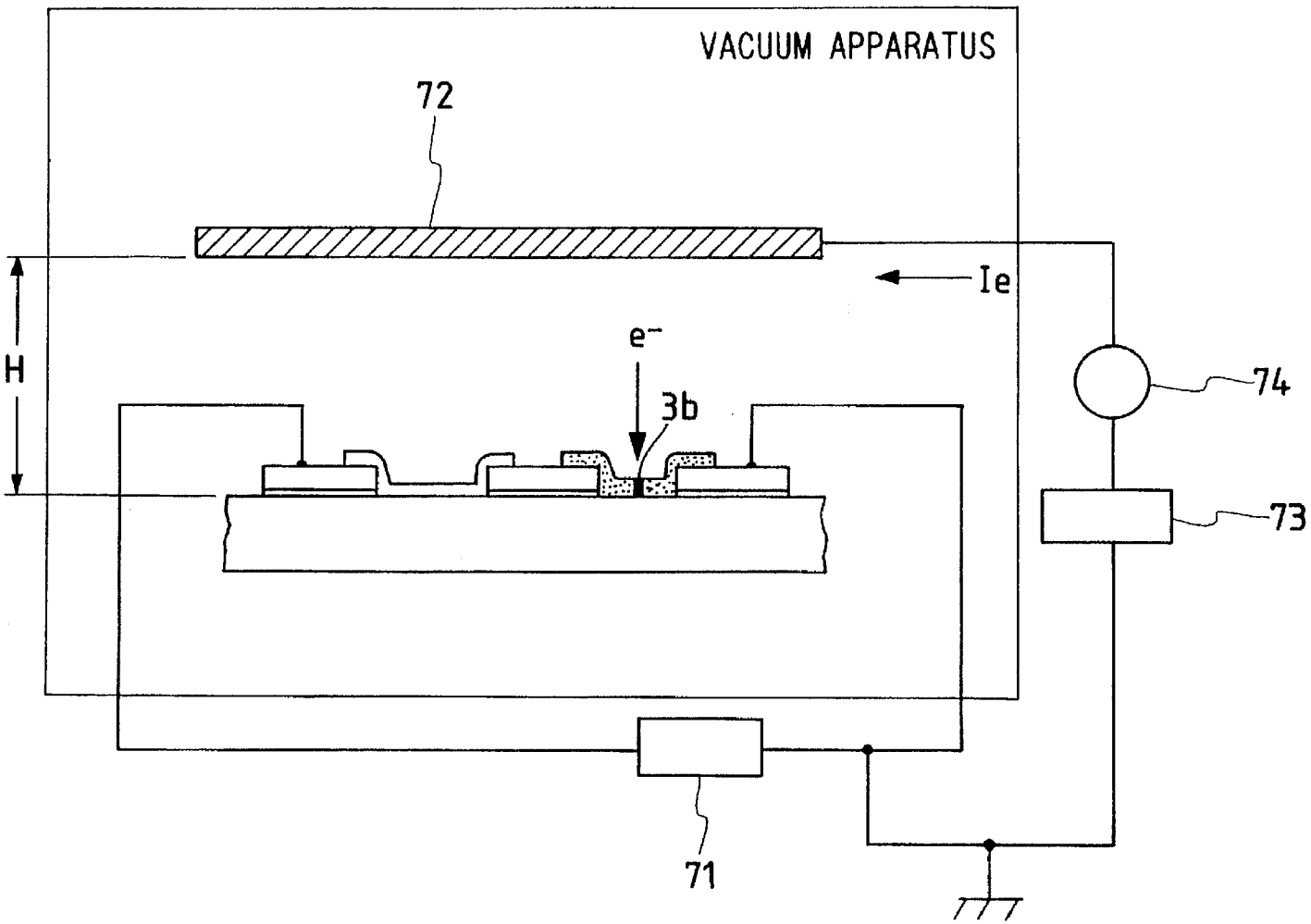
FIG. 5 is a diagram showing an evaluation device for evaluating an output characteristic of the electron emitting element of surface condition type.

FIG. 5 shows one schematic configuration of a measurement/evaluation device for checking an electron emitting characteristic of the electron emitting element of surface conduction type.

In FIG. 5, denoted by 71 is a power supply for applying an element voltage Vf, i.e. a driving voltage applied to an electron emitting element, to the electron emitting element of surface conduction type, 72 is an anode electrode for capturing an emission current Ie emitted from the electron emitting element of surface conduction type, 73 is a high-voltage power supply for applying a voltage to the anode electrode 72, and 74 is an ammeter for measuring the emission current Ie. The electron emitting element of surface conduction type and the anode electrode 72 are installed in a vacuum apparatus which is provided with equipment such as an exhaustion pump and a vacuum gauge (not shown) necessary for measurement and evaluation under a desired vacuum.

Actual measurement and evaluation were made on condition that a voltage applied to the anode electrode by the high-voltage power supply 73 was set to the range of 1 KV to 10 KV and a distance H between the anode electrode and the electron emitting element of surface conduction type was set to the range of 3 mm to 8 mm.

Figure 6:
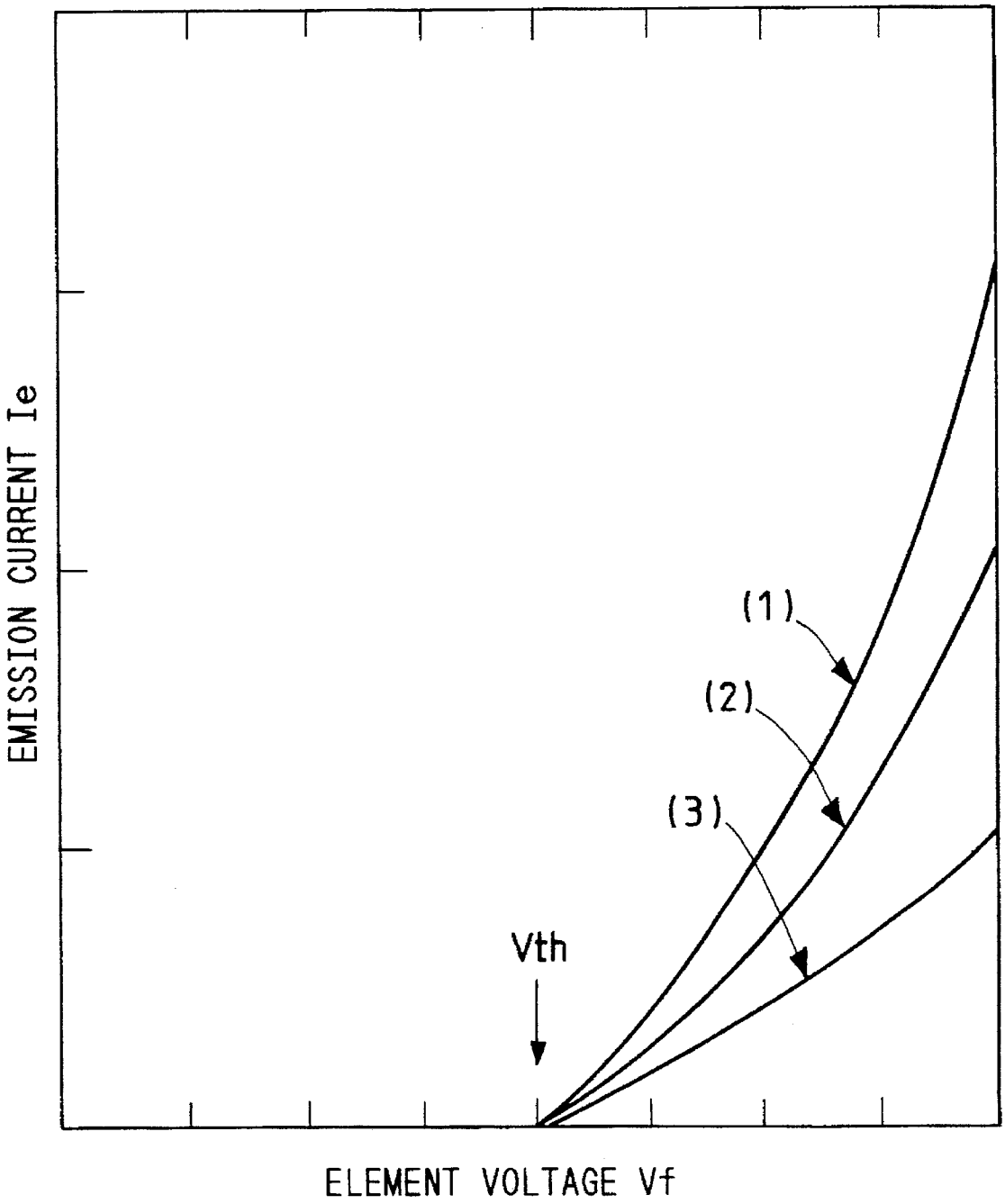
FIG. 6 is a graph showing examples of an output characteristic of the electron emitting element of surface condution type according to the electron source of the present invention.

FIG. 6 shows an output characteristic of the electron emitting element of surface conduction type measured by the above measurement/evaluation device. Note that since an absolute value of the output characteristic depends on a size and shape of the element, a characteristic graph of FIG. 6 is plotted in an arbitrary unit.

When the three electron emitting portions 3*a*, 3*b*, 3*c* of the electron emitting element of surface conduction type are all good, the emission current Ie exhibits a characteristic indicated by (1) in FIG. 6. When any two of the three electron emitting portions are good, the Ie exhibits a characteristic indicated by (2) in FIG. 6. Further, when only one of the three electron emitting portions is good, the Ie exhibits a characteristic indicated by (3) in FIG. 6.

If the three electron emitting portions are all not good although this rarely happens in terms of probability, the emission current Ie is not appreciably detected. In this case, the relevant element is not used. But if a failed portion can be repaired, that element is checked again after the repair. If a failed portion is difficult to restore by repair, it is preferable to reuse that element as raw material from the standpoint of environment and resources.

According to the present invention, when the electron emission characteristic is as indicated by (1), that element is used as it is. However, when the electron emission characteristic is as indicated by (2) or (3), one or two thermally cut-off portions electrically connected to the failed electron emitting portions in series are selectively heated so as to burn out or cut off the electrical connection therebetween.

The process up to the above disconnection will now be described.

Figure 27:
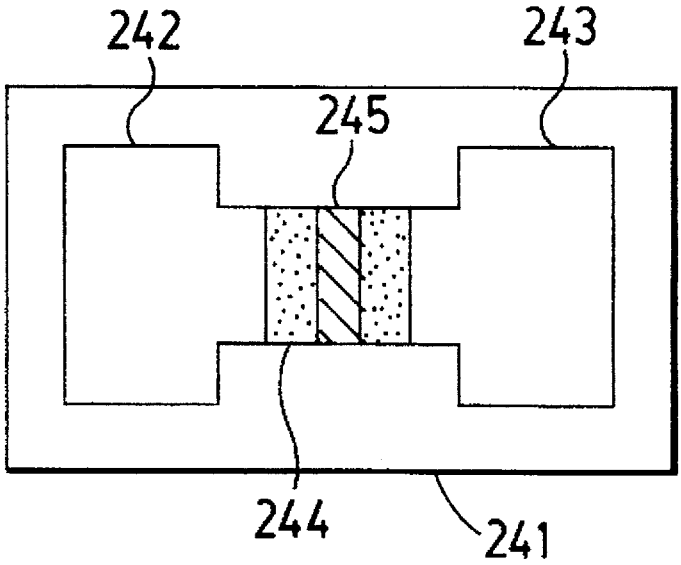
FIG. 27 PRIOR ART
FIG. 27 is a plan view showing one example of prior art electron emitting elements of surface conduction type.
Figure 28:
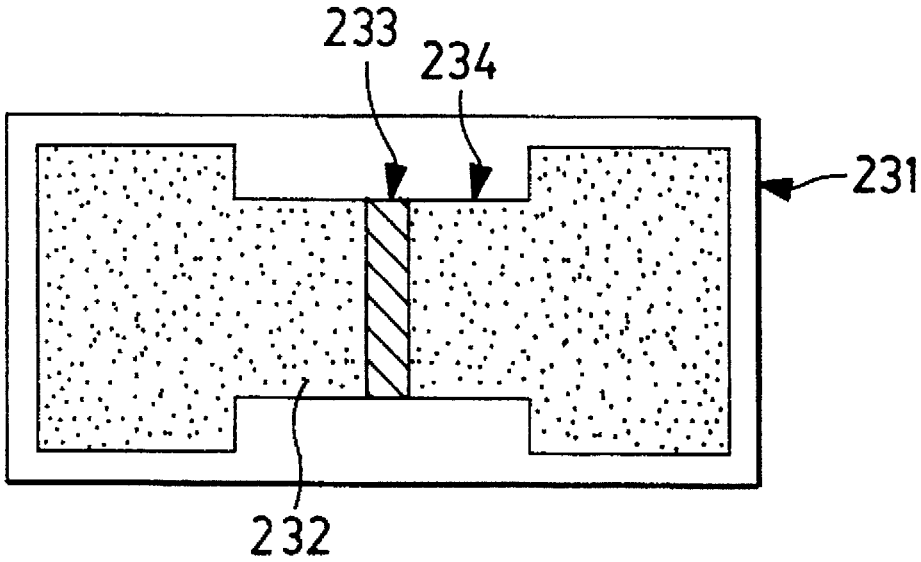
FIG. 28 PRIOR ART
FIG. 28 is a plan view showing another example of prior art electron emitting elements of surface conduction type.

For the electron emitting element of surface conduction type on which the electron emission characteristic has been found as indicated by (2) or (3), a check is performed by a method of using image processing in order to discriminate which one(s) of the three electron emitting portions 3*a*, 3*b*, 3*c* is good and which one(s) of them includes a failure or defect. As explained before with reference to the examples of FIG. 27, the electron emitting portion forming thin film including a failure or defect has a configurational feature such as a chip or projection in its surroundings. This feature is still left after the electrification 'forming'. Therefore, the good electron emitting portion can easily be discriminated from one including a failure or defect based on their configurations.

In practice, the check is performed by using, for example, an image sensing device such as an industrial TV camera provided with a magnifying lens, image memories and an image processor. More specifically, the image of the electron emitting element of surface conduction type is picked up by the image sensing device, and image data is once stored in one image memory. On the other hand, an image pattern of the normal element is stored in another image memory beforehand. The image processor executes a pattern matching between the normal image pattern and the sensed image data and, when the both are matched with each other, it determines that element to be normal.

The subsequent step will be described on an assumption that the electron emission characteristic was found as indicated by (2) in FIG. 6 and the normal electron emitting portion was not formed in the electron emitting portion forming thin film 42*b* as a result of the determination made based on the check method using image processing.

(Step-9)

In this embodiment, the thermally cut-off portion 44*b* connected to the abnormal electron emitting portion in series was selectively heated by a laser beam, for example, thereby cutting off the electrical connection therebetween.

Figure 3H:
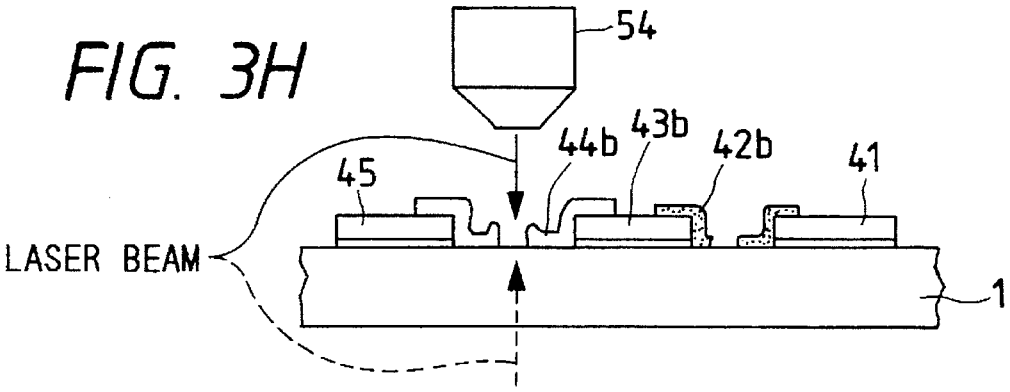

More specifically, as shown in FIG. 3H, the thermally cut-off portion 44*b* was locally irradiated with a laser beam from a laser source 54 so that it was molten to cut off the electrical connection. The laser source 54 can be any of infrared lasers such as a carbon dioxide laser, CO laser and YAG laser, for example. It is only required for the laser source to be able to produce a relatively high power and easily effect heating. Other than irradiating the laser beam directly to the thermally cut-off portion 44*b* as shown in FIG. 3H, a transparent member may be interposed between the laser source and the portion 44*b*, or as shown in the drawing by the broken line, the laser beam may be irradiated from the lower surface side of the glass base plate 1 depending on cases.

One electron emitting element of surface conduction type in the electron source of this embodiment manufactured as explained above is shown in FIG. 7.

(Embodiment 2)

The construction of the electron emitting elements of the electron source according to the first aspect of the present invention is not limited to that described above with reference to FIGS. 2 to 7. The thermally cut-off portion is not necessarily separated from the electron emitting portion forming thin film. In accordance with the basic concept of the first aspect of the present invention, a part of the electron emitting portion forming thin film may also serve as the thermally cut-off portion.

Figure 8:
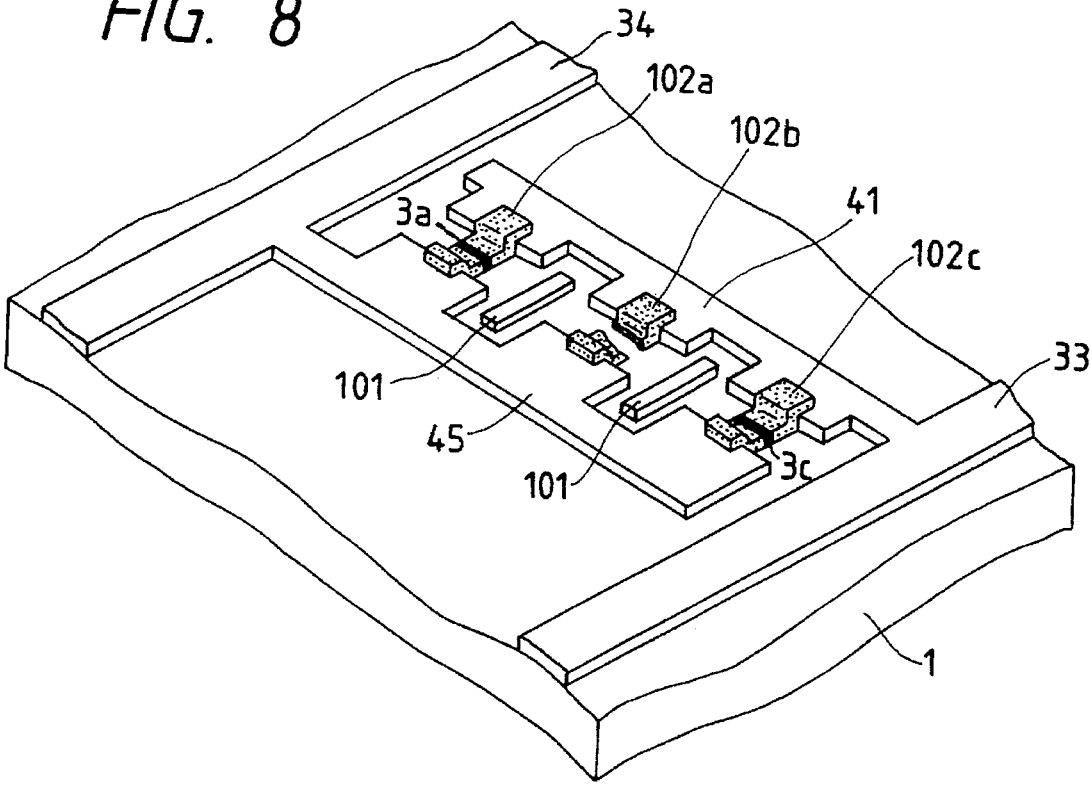
FIG. 8 is a perspective view showing a practical configuration of an electron emitting element of surface conduction type used in another embodiment of the electron source according to the first aspect of the present invention.

FIG. 8 is a view for explaining such an embodiment. In this embodiment, electron emitting portion forming thin films 102*a*, 102*b*, 102*c* are formed between the electrodes 41 and 45, and a scattering preventive member 101 is provided between adjacent pairs of the electron emitting portion forming thin films.

Figure 7:
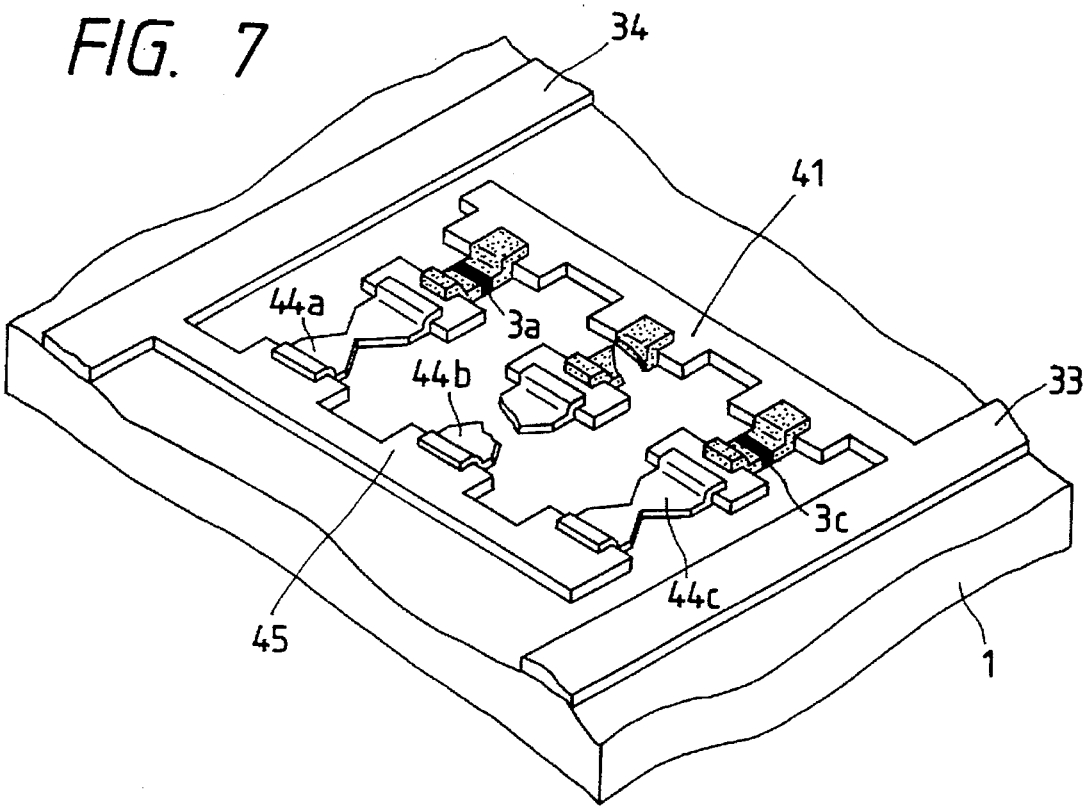
FIG. 7 is a perspective view showing the electron emitting element of surface conduction type, in which electrical connection is cut off in an electron emitting portion being not normal, for the electron source according to the first aspect of the present invention.

As with the embodiment of FIG. 7, FIG. 8 is drawn on an assumption that the central one of the three electron emitting portions was not normally formed. Instead of the thermally cut-off portion 44*b* in FIG. 7, a part of the electron emitting portion forming thin film 102*b* is irradiated with a laser beam to cut off the electrical connection this embodiment.

The scattering preventive member 101 is provided to prevent, when the electron emitting portion forming thin film is heated by a laser beam, fragments of the thin film from scattering to the adjacent normal electron emitting portions and adversely affecting them. The scattering preventive member 101 can be formed of the same material as the electrodes 41, 45, but it is made more effective by setting a thickness to be not less than 1 micron, for example.

(Embodiment 3)

The construction of the electron source according to the first aspect of the present invention is not limited to that schematically shown in FIG. 1.

The number of the electron emitting portions provided electrically in parallel for each element is not limited three. It is important that plural electron emitting portions are provided in each element. For example, each element may include six electron emitting portions. Also, the electron emitting portions are not necessarily arranged in a line.

Figure 9:
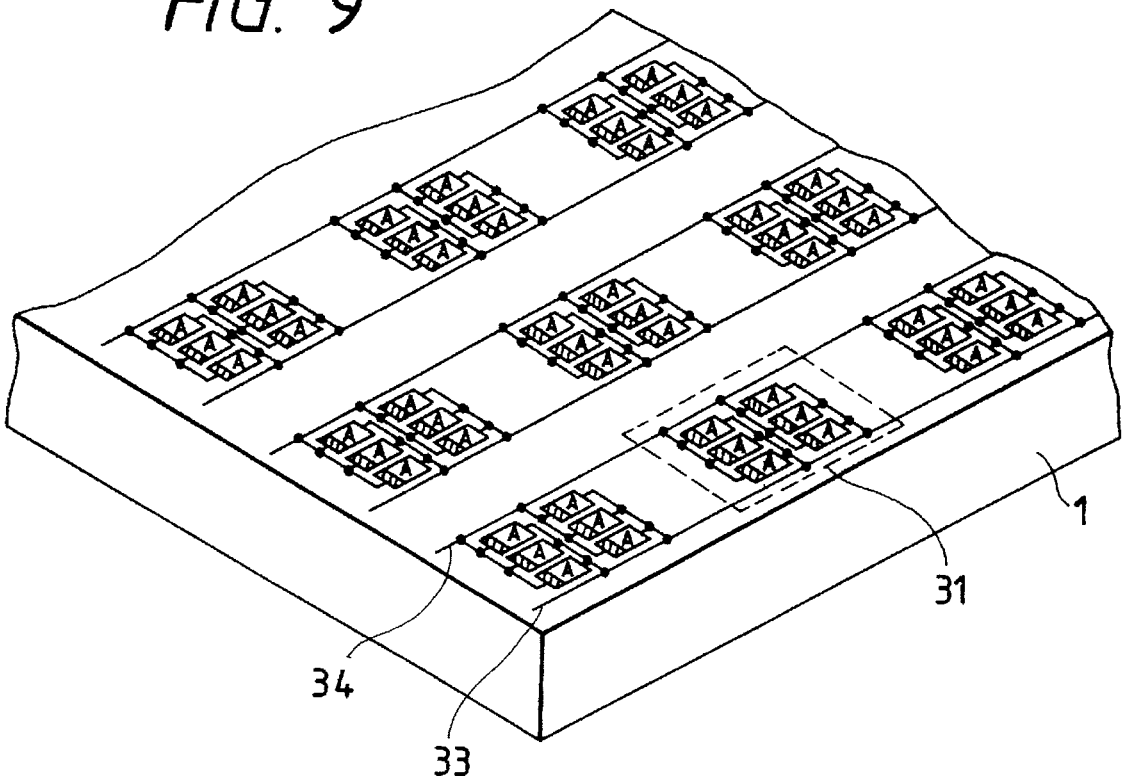
FIG. 9 is a schematic view for explaining another embodiment of the electron source according to the first aspect of the present invention.
Figure 10:
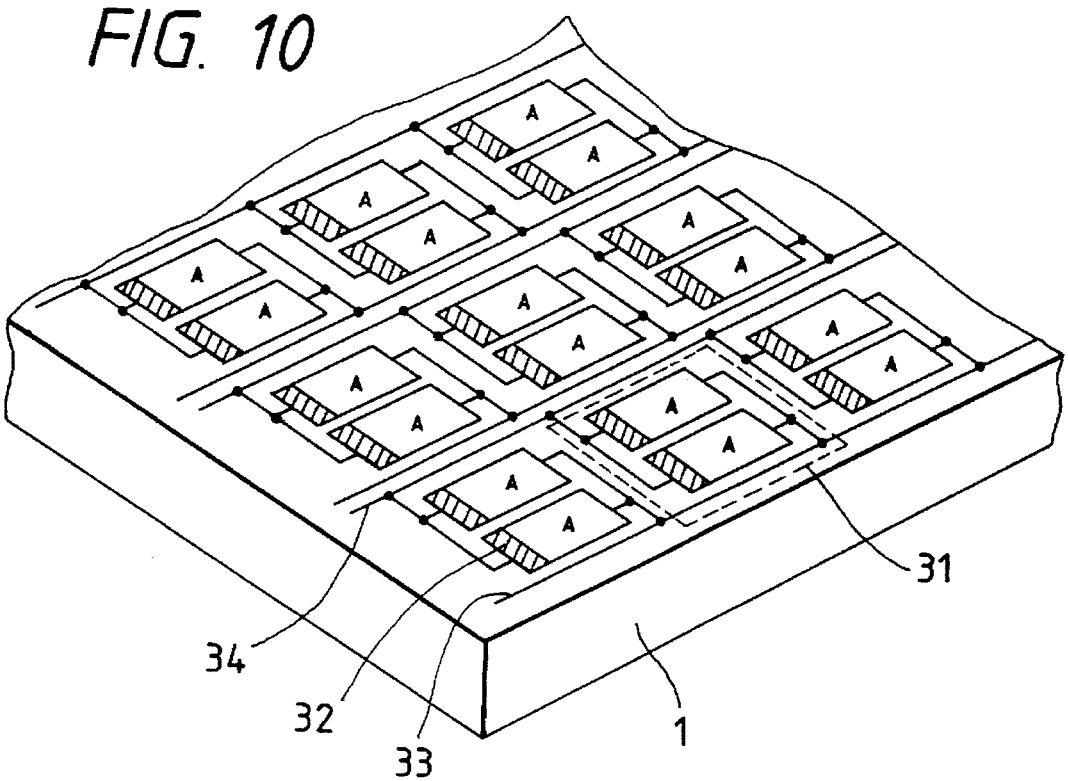
FIG. 10 is a schematic view for explaining still another embodiment of the electron source according to the first aspect of the present invention.

As schematically shown in FIG. 9, for example, one element 31 may include six portions A electrically connected in parallel, these six portions A being spatially arranged in two rows each comprising three portions A. Alternatively, as schematically shown in FIG. 10, one element 31 may include two portions A.

(Embodiment 4)

Figure 11:
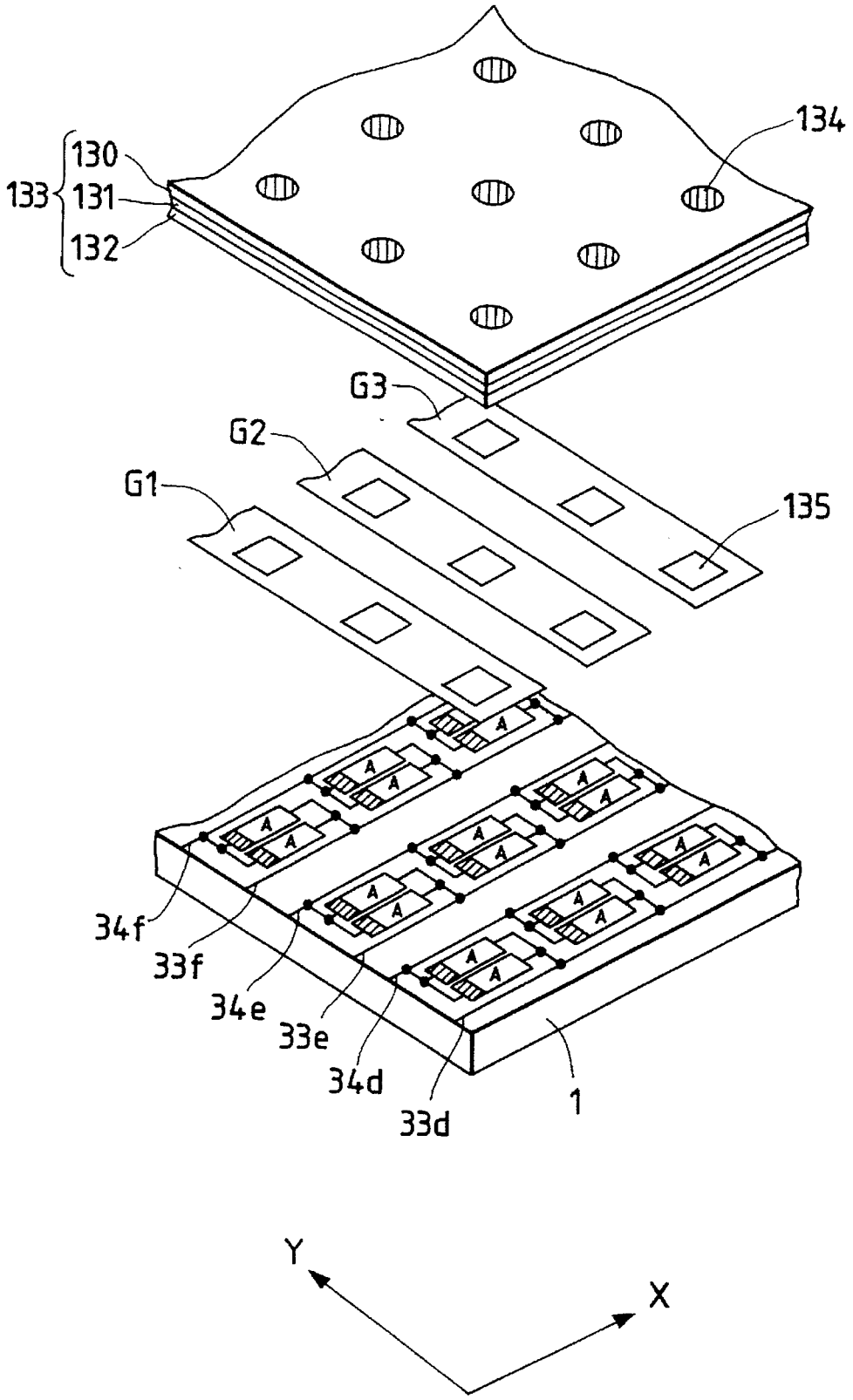
FIG. 11 is a schematic view of a display using the electron sources according to the first aspect of the present invention.

In this embodiment, a description will be given of one example of an image display using the electron source shown in FIG. 10. FIG. 11 is a schematic view showing a display panel of the image display of this embodiment.

Referring to FIG. 11, denoted by 1 is a base plate of the electron source, G1, G2, G3 are grid electrodes for modulating respective electron beams, and 133 is a face plate of the display panel.

FIG. 11 shows an area including only nine pixels in the display panel comprised of numerous pixels. The face plate 133 and the base plate 1 double as a part of a vacuum vessel (not shown), and a vacuum level of about $10^{-6}$ [Torr], for example, is maintained inside the vessel. Also, the face plate 133 is constituted by forming a transparent electrode 131 formed of an ITO thin film, for example, and a fluorescent material 132 on an inner surface of a base plate 130 made of glass, for example. Depending on cases, a metal back well known in the art of CRT may be provided at the underside of the fluorescent material 132.

A voltage of 10 KV, for example, is applied to the transparent electrode 131 by a high-voltage power supply (not shown), and the fluorescent material 132 emanates a visible light upon irradiation of an electron beam.

The grid electrodes G1, G2, G3 are each a stripe-shaped electrode fabricated by machining a thin plate of metal material, for example, and provided with openings 135 in alignment with the corresponding the electron emitting elements of surface conduction type so that electron beams pass through the electrodes. The grid electrodes are electrically independent of one another and, by changing the magnitude of a modulation voltage externally applied to each of the grid electrodes, the intensity of an electron beam passing through the opening 135 and irradiating the fluorescent material can be controlled. Also, by changing the time length (duration) of a modulation voltage pulse, the amount of charges of an electron beam passing through the opening 135 and irradiating the fluorescent material can be controlled. Accordingly, by adjusting the magnitude of the modulation voltage applied to the grid electrode or the duration of the modulation voltage pulse, the luminance of a light emanated from the fluorescent material can freely be controlled.

Further, similarly to the electron source shown in FIG. 10, numerous electron emitting elements 31 of surface conduction type (see FIG. 10) are formed into an array on the glass base plate 1. The electron emitting elements of surface conduction type arrayed in the X direction are interconnected electrically in parallel. Denoted by 33*d*, 34*d*, 33*e*, 34*e*, 33*f* in FIG. 11 are common wired electrodes for establishing such parallel connection.

In the display panel of this embodiment, rows of electron emitting elements of surface conduction type formed in the array in the X direction and columns of stripe-shaped grid electrodes formed to extend in the Y direction cooperatively form an XY matrix. Stated otherwise, by applying a suitable drive voltage to one of the common wired electrode pairs, any one of the element rows can selectively be driven, and by applying suitable modulation signals to the grid electrodes at the same time, electron beams emitted from that element row can be modulated individually. As a result, by successively changing over the element rows to be driven, all pixels (denoted by 134 in FIG. 11) of a display screen can be scanned in turn.

Figure 12:
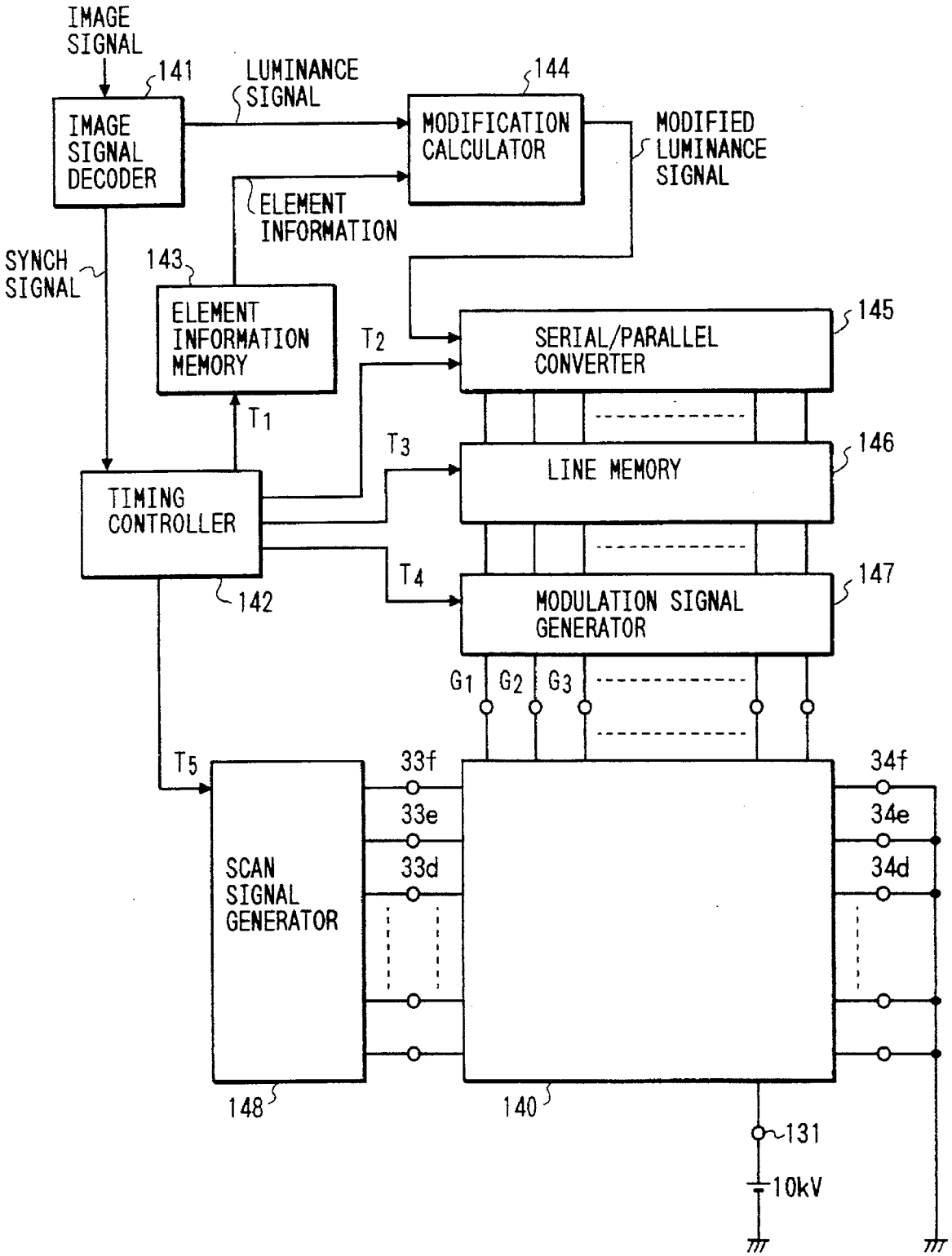
FIG. 12 is a simplified block diagram for explaining a driver circuit of the display shown in FIG. 11.

FIG. 12 is a simplified block diagram showing an electric circuit configuration for driving the display panel of FIG. 11 in accordance with an image signal externally input thereto.

Referring to FIG. 12, denoted by 140 is the display panel shown in FIG. 11, 141 is an image signal decoder, 142 is a timing controller, 143 is an element information memory, 144 is a modification calculator, 145 is a serial/parallel converter, 146 is a line memory, 147 is a modulation signal generator, and 148 is a scan signal generator. The functions of these components will be described below.

The image signal decoder 141 is a circuit for separating and reproducing a synch signal component and a luminance signal component from a composite image signal such as an NTSC television signal, for example, externally applied to the decoder. The reproduced synch signal and luminance signal are input to the timing controller 142 and the modification calculator 144, respectively.

The timing controller 142 is a circuit for adjusting the timing in operations of the components, and generates timing control signals based on the synch signal. More specifically, the timing controller 142 outputs a timing control signal T1 to the element information memory 143, T2 to the serial/parallel converter 145, T3 to the line memory 146, and T4 to the modulation signal generator 147.

The element information memory 143 is a memory in which the number of normal electron emitting portions, i.e., the number of those electron emitting portions which still have their thermally cut-off portions not cut off, for each of all the electron emitting elements of surface conduction type is stored beforehand. In response to the timing control signal T1, the element information memory 143 reads data of the stored contents and outputs it to the modification calculator 144.

The timing control signal T1 adjusts the timing so that information about the electron emitting element of surface conduction type for the relevant pixel is read out in synch with the luminance signal transmitted from the image signal decoder 141 to the modification calculator 144.

The modification calculator 144 is a calculation circuit for modifying the luminance signal input from the image signal decoder 141 in accordance with the element information input from the element information memory 143.

The calculation is executed, by way of example, as follows. Upon a luminance signal of any one pixel being input, when two electron emitting portions of the corresponding electron emitting element of surface conduction type are both normal, the luminance signal is multiplied by one. When only one of the two electron emitting portions is normal, the luminance signal is multiplied by two. The coefficient 1 or 2 is multiplied in this embodiment because each electron emitting element of surface conduction type includes two portions A in the display panel of FIG. 11. It is needless to say that in the case of using other electron emitting elements of surface conduction type each of which having different numbers of the portions A as shown in FIGS. 1 and 2, the luminance signal is multiplied by different values of the coefficient depending on the number of normal electron emitting portions.

Further, a calculation method is not limited to the above-explained method. It is essential that a light emitting characteristic of the display panel can be modified by the calculation method depending on the number of normal electron emitting portions. For example, a non-linear calculation method of changing a coefficient value in accordance with the luminance signal may also be used.

The luminance signal modified by the modification calculator 144 is input to the serial/parallel converter 145 which converts serial image data of one line into parallel one and outputs it to the line memory 146.

The line memory 146 is a memory for storing the image data of one line for a predetermined period. The stored image data is then output to the modulation signal generator 147.

The modulation signal generator 147 generates modulation signals for one line of an image in accordance with the image data and applies the modulation signals to the grid electrodes G1, G2, G3, . . . of the display panel. The modulation signal may be a voltage modulation type signal of which voltage is changed in accordance with the image data, or a pulse width modulation type signal of which duration is changed in accordance with the image data.

On the other hand, the scan signal generator 148 is a circuit for selectively driving one row of the electron emitting elements of surface conduction type in response to the timing control signal T5 generated by the timing controller 142. The scan signal generator 148 applies a drive voltage to one of the common wiring electrodes 33*f*, 33*e*, 33*d*, . . . which corresponds to the element row to be driven, and also 0 [V], i.e., a ground level, to the remaining common wiring electrodes corresponding to the element rows not to be driven.

Since the opposite common wiring electrodes 34*f*, 34*e*, 34*d*, . . . are connected to the ground level, the drive voltage generated by the scan signal generator 148 can selectively drive any one element row.

The scan signal generator 148 and the modulation signal generator 147 are adjusted in timing of the operation by virtue of the timing controller 142. Therefore, the display panel 140 can display an image line by line successively in accordance with the input image signal.

In the above-described image display, since an abnormal electron emitting portion in each electron emitting element of surface conduction type is electrically disconnected at its thermally cut-off portion and a modulation signal modified depending on the number of normal electron emitting portions is applied to a corresponding grid electrode, an image can be displayed at luminance with high fidelity to an original image signal even when a part of the electron emitting portions is not normal.

Figure 13:
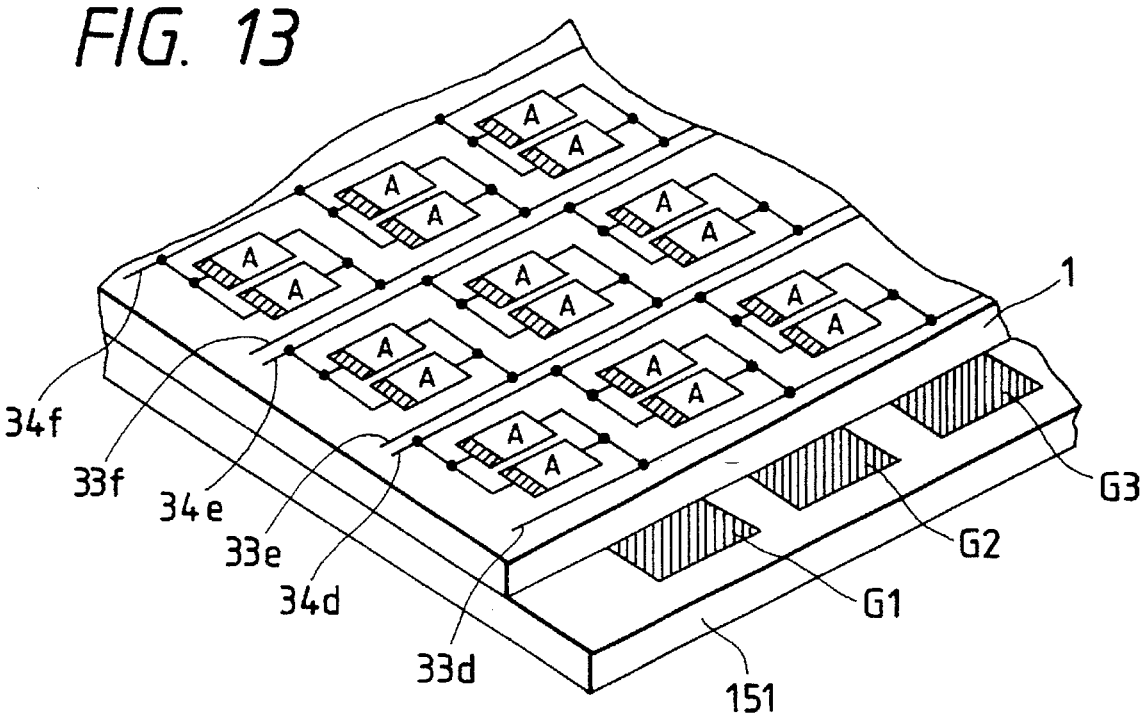
FIG. 13 is a schematic view for explaining still another embodiment of the electron source according to the first aspect of the present invention.

In the above-described image display, the grid electrodes G1, G2, G3, . . . for modulation are provided between the electron emitting elements of surface conduction type and the fluorescent material 132, as explained before with reference to FIG. 11. An arrangement of the grid electrodes is not limited to such a position, but they may be provided below the electron emitting elements of surface conduction type, for example, as shown in FIG. 13. Referring to FIG. 13, the grid electrodes G1, G2, G3, . . . are formed on a base plate 151 separate from the base plate 1 on which the electron emitting element of surface conduction type are formed. It is essential for an arrangement of the grid electrodes that an electric field distribution around each electron emitting element can be changed with a modulated voltage applied to the corresponding grid electrode and a path of the electron beam can be controlled. Accordingly, the grid electrodes may be formed at the underside of the glass base plate 1 on which the electron emitting elements are formed or, depending on cases, may be provided on the same plane as the electron emitting elements.

(Embodiment 5)

While an XY matrix is constituted by rows of the electron emitting elements of surface conduction type and the grid electrodes in above Embodiment 4, a method of constituting the matrix is not limited to it.

Figure 14:
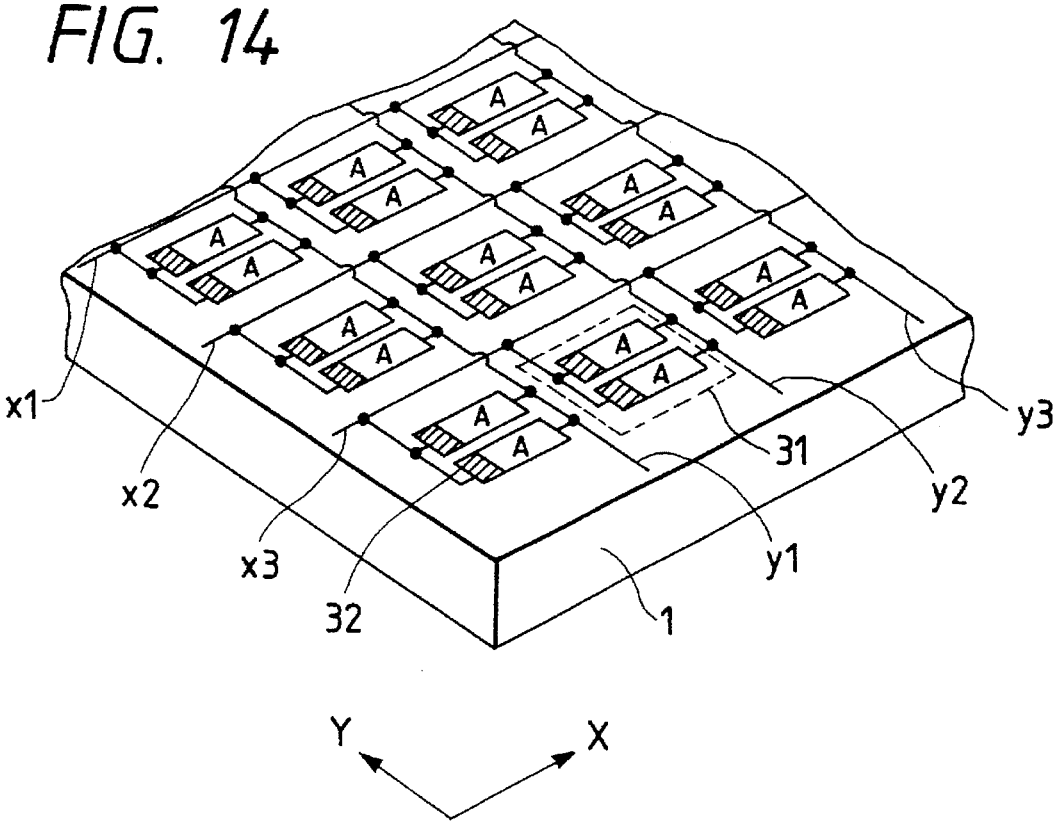
FIG. 14 is a schematic view for explaining still another embodiment of the electron source according to the first aspect of the present invention.

As schematically shown in FIG. 14, for example, an electron source can also be provided by making the electron emitting elements 31 of surface conduction type wired into a simple matrix, without using any grid electrodes.

In FIG. 14, x1, x2, x3, . . . are each a common electrode for interconnecting those ones of the electron emitting elements 31 of surface conduction type formed on the base plate 1 which are arrayed as one row in the X direction, whereas y1, y2, y3, . . . are each a common electrode for interconnecting those ones of the electron emitting elements 31 of surface conduction type which are arrayed as one column in the Y direction.

With this embodiment, by applying appropriate drive signals to the common electrodes, any one of the electron emitting elements of surface conduction type can be driven selectively. At this time, the intensity of an electron beam to be output can be controlled by changing the magnitude of a voltage of the drive signal, and the total amount of electron charges to be output can be controlled by changing the duration of each pulse of the drive signal. Accordingly, when such an electron source is applied to a display, for example, the display luminance can be modulated without using any grid electrodes.

Figure 15:
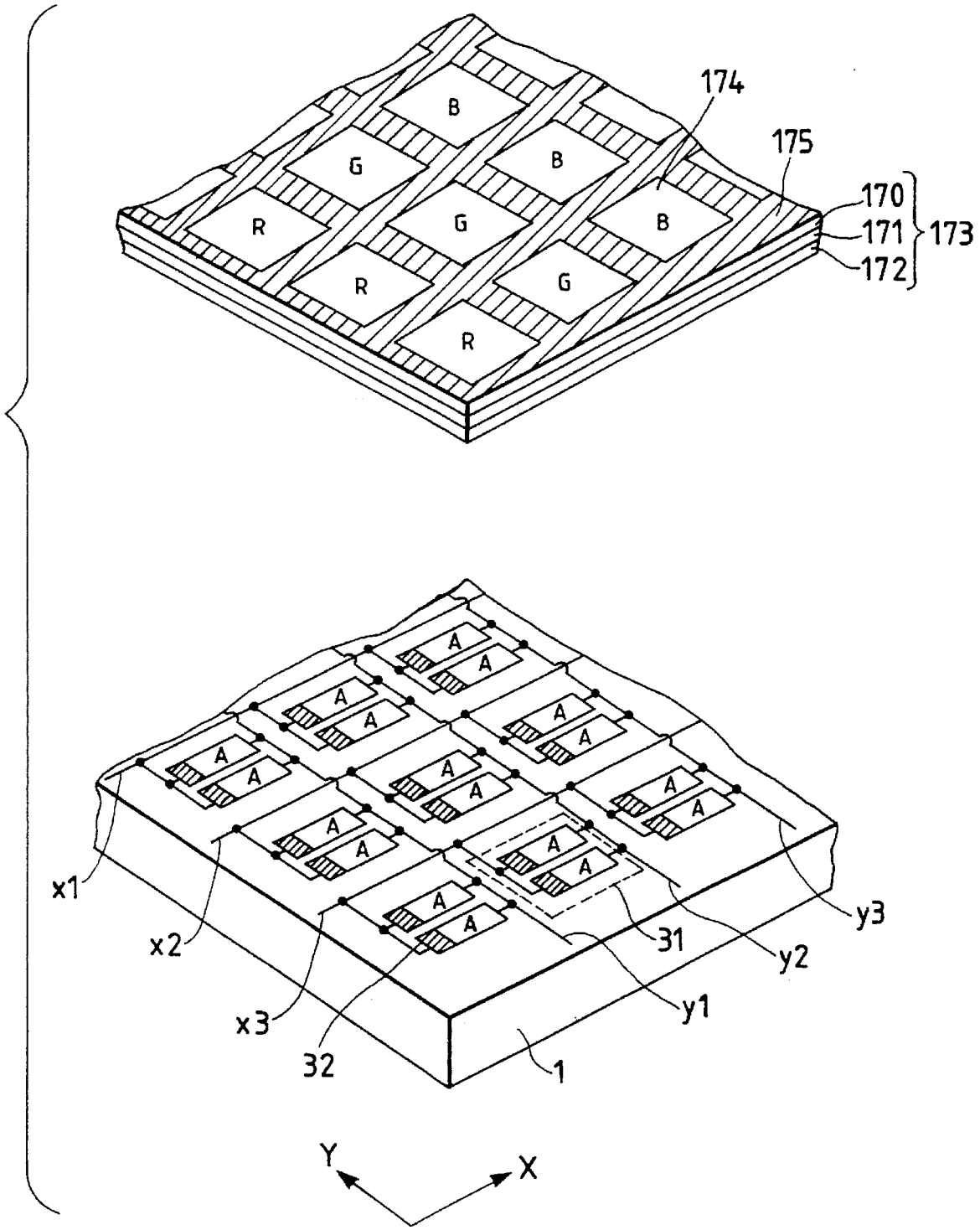
FIG. 15 is a schematic view of a display using the electron sources shown in FIG. 14.

FIG. 15 shows a part of a display panel using the electron source of FIG. 14. In FIG. 15, denoted by 173 is a face plate. The face plate 173 comprises a transparent base plate 170 made of glass, for example, a transparent electrode 171 laminated on the base plate 170 and a fluorescent layer 172 where fluorescent materials 174 in a mosaic pattern and a black substance 175 is selectively applied or coated (into the so-called black matrix). Depending on cases, a metal back well known in the art of CRT may be provided in addition to the above.

The fluorescent materials 174 are disposed in the fluorescent layer 172 in a mosaic pattern corresponding to the electron emitting elements of surface conduction type in one to one relation. Also, the fluorescent materials 174 are applied by selectively coating a red fluorescent substance R, a green fluorescent substance G, and a blue fluorescent substance B, as shown.

Additionally, as with the display of FIG. 11, the face plate 173 and the base plate 1 double as a part of a vacuum vessel.

Further, a high voltage of 10 KV, for example, is applied to the transparent electrode 171.

Figure 16:
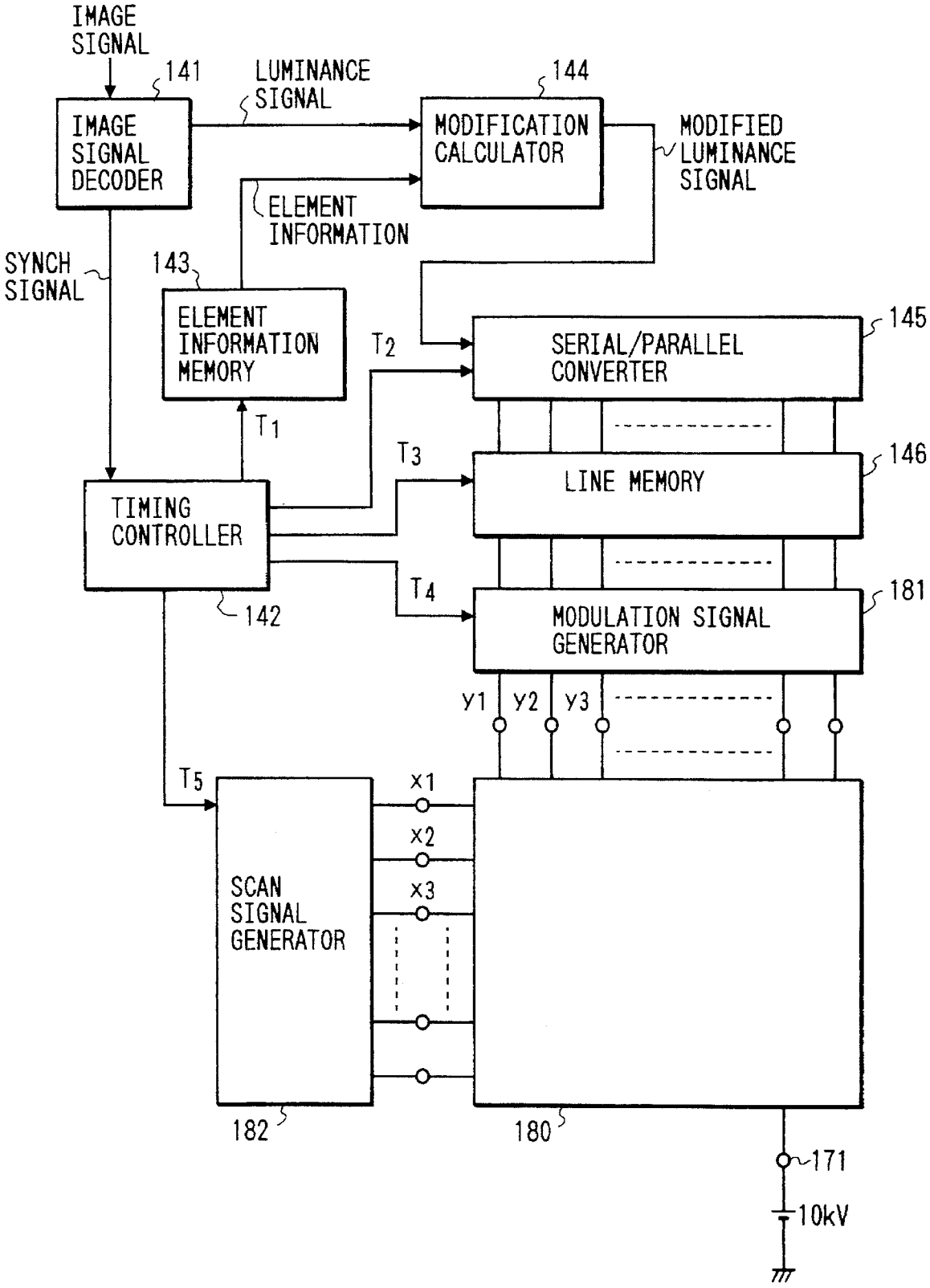
FIG. 16 is a simplified block diagram for explaining a driver circuit of the display shown in FIG. 14.

FIG. 16 is a simplified block diagram showing an electric circuit configuration for driving the display panel of FIG. 15 in accordance with an image signal externally input thereto.

Referring to FIG. 16, denoted by 180 is the display panel shown in FIG. 15. Circuit components such as an image signal decoder 141, a timing controller 142, an element information memory 143, a modification calculator 144, a serial/parallel converter 145, and a line memory 146 have the same functions as those shown in FIG. 12 and hence will not be described here.

In this embodiment, a scan signal generator 182 and a modulation signal generator 181 are adapted for driving the electron source of FIG. 14. The modulation signal generator 181 generates modulation signals in accordance with luminance signals which have been modified depending on the number of normal electron emitting portions, similarly to the embodiment of FIG. 12.

The embodiments relating to the first aspect of the present invention has been described above. A second aspect of the present invention will be described below with reference to FIGS. 17 to 25.

According to the second aspect of the present invention, an electron source is basically arranged such that a plurality of electron emitting portion forming thin films are provided beforehand for each electron emitting element, at least one of those thin films is electrically connected to a voltage supply electrode through a thermally cut-off portion, and at least other one of those thin films is kept not electrically connected to the voltage supply electrode. The electron emitting portion forming thin film electrically connected is then subjected to an electrification 'forming' through the voltage supply electrode to form an electron emitting portion. After that, a characteristic of the formed electron emitting portion is checked. For the electron emitting portion which exhibits an unsatisfactory characteristic, the electrical connection is cut off completely by heating the thermally cut-off portion to disable application of a drive signal. In addition, the electron emitting portion forming thin film not yet electrically connected is now connected to the voltage supply electrode and then subjected to an electrification 'forming'. In other words, when an electron emitting portion having a good characteristic is not formed in the electron emitting portion forming thin film which has been electrically connected beforehand, another electron emitting portion is separately formed in the spare electron emitting portion forming thin film which has not yet been electrically connected.

(Embodiment 6)

Figure 17:
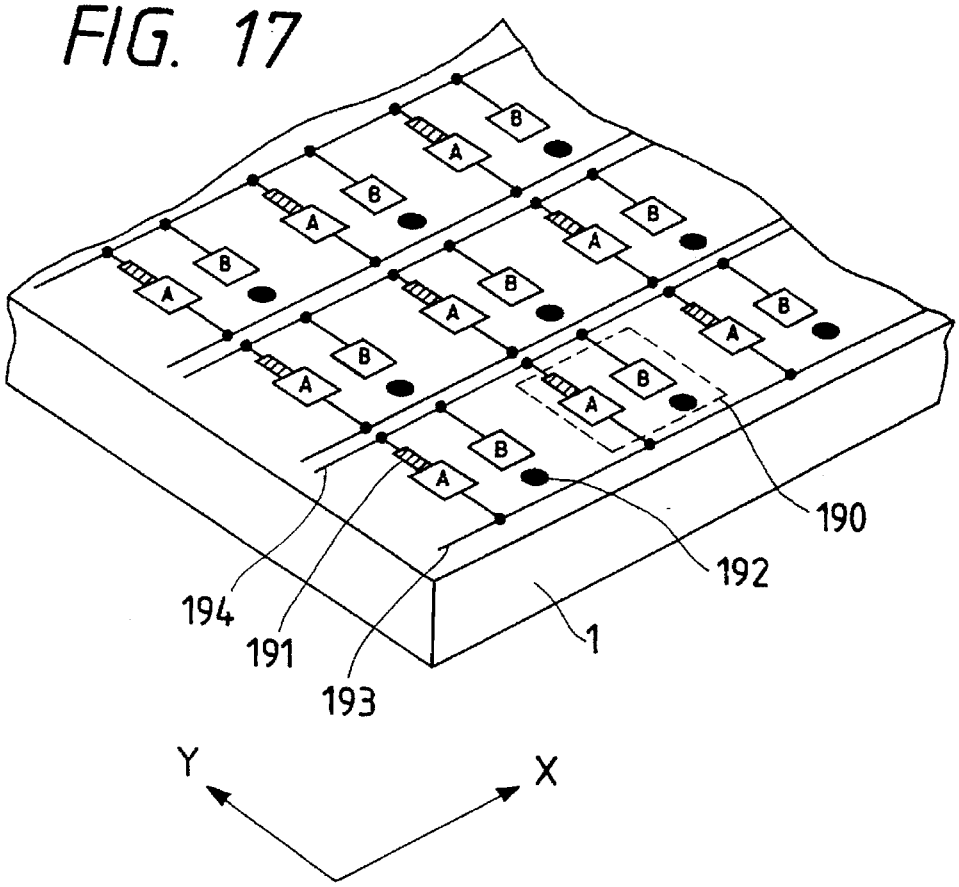
FIG. 17 is a schematic view for explaining an embodiment of an electron source according to a second aspect of the present invention.

FIG. 17 is a schematic view for explaining one embodiment of an electron source according to the second aspect of the present invention. A part of the electron source comprising numerous electron emitting elements of surface conduction type.

In FIG. 17, a reference numeral 1 denotes a base plate and an area 190 defined by dotted lines schematically represents one of the numerous electron emitting elements of surface conduction type which are formed on the base plate 1. Only a group of nine of those numerous elements are illustrated in FIG. 17.

Each electron emitting element 190 of surface conduction type includes, as constituent members, a portion indicated by A in FIG. 17 (hereinafter referred to as a portion A), a portion indicated by B (hereinafter referred to as a portion B), a thermally cut-off portion 191, and a thermally connecting member 192.

More specifically, the portion A represents an electron emitting portion forming thin film previously connected to both voltage supply electrodes, and surroundings thereof.

The portion B represents an electron emitting portion forming thin film initially not connected to one of the voltage supply electrodes, and surroundings thereof.

The thermally cut-off portion 191 represents a member which has good conductivity at the room temperature, but which is changed into an electrically insulated state by being molten or oxidized when heated.

The thermally connecting member 192 represents a member which is molten or deformed when heated, thereby changing a state so that the portion B and the above one voltage supply electrode are electrically connected to each other since then.

Further, 193 and 194 schematically represent voltage supply electrodes for electrically connecting the electron emitting elements of surface conduction type in parallel which are arrayed in the X direction, and supplying a voltage to those elements.

The electron emitting element 190 of surface conduction type will now be described in more detail.

Figure 18:
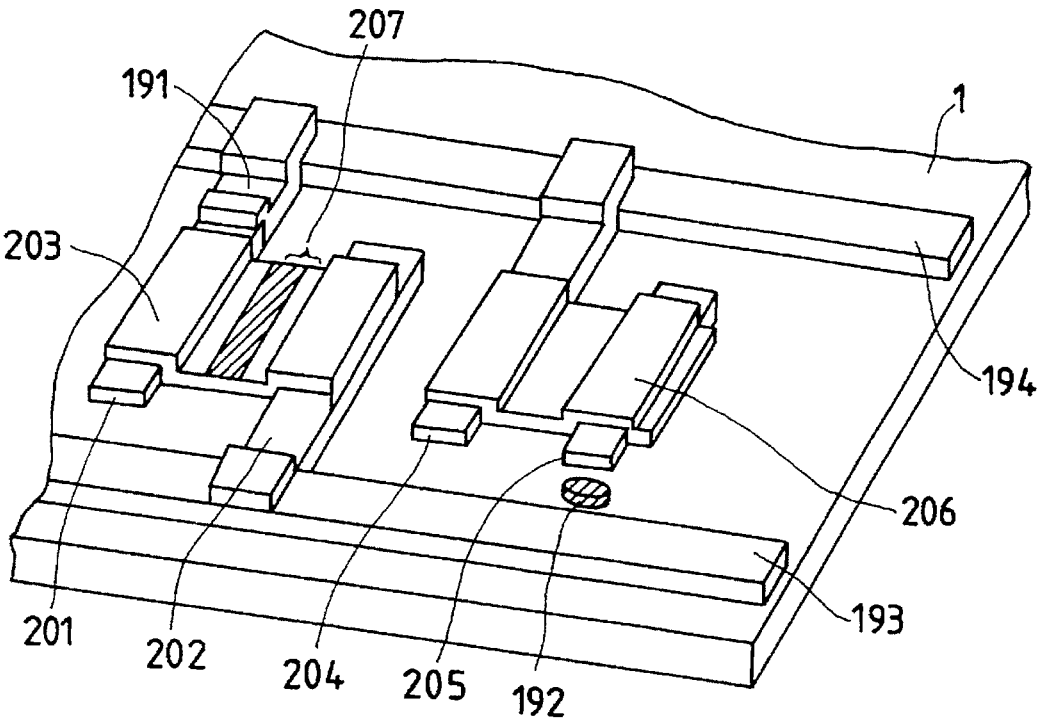
FIG. 18 is a perspective view showing one practical configuration of an electron emitting element of surface conduction type according to the electron source shown in FIG. 17.

FIG. 18 is a perspective view showing one example of the electron emitting element of surface conduction type. In FIG. 18, denoted by 1 is a base plate formed of soda line glass, for example, 191 is a thermally cut-off portion made of $In_2O_3$, for example, 192 is a thermally connecting member formed of a solder or the like containing Pb and Sn as ingredients, for example, 193 and 194 are voltage supply electrodes made of Ni, for example, 201 and 202 are element electrodes, 203 is an electron emitting portion forming thin film, 204 and 205 are element electrodes, and 206 is an electron emitting portion forming thin film.

Of these components, the element electrodes 201, 202 and the electron emitting portion forming thin film 203 jointly constitute the aforesaid portion A, whereas the element electrodes 204,205 and the electron emitting portion forming thin film 206 jointly constitute the aforesaid portion B.

The thermally cut-off portion 191 can be formed similarly to that described above in connection with the embodiment of FIG. 2, etc. The thermally connecting member 192 is preferably made of such material as having conductivity and being easily molten when heated.

In this embodiment, the 'forming' voltage is first applied between the voltage supply electrodes 193 and 194 to form an electron emitting portion 207 in the electron emitting portion forming thin film 203. Note that since the 'forming' voltage and vacuum conditions during the 'forming' are the same as those mentioned above in connection with the embodiments according in the first aspect of the present invention.

Then, as electron emission characteristic of the electron emitting portion 207 formed in the electron emitting portion forming thin film 203 is checked by using the measurement/evaluation device explained above with reference to FIG. 5.

According to the second aspect of the present invention, when the result of the check shows that the electron emitting portion 207 has a normal characteristic, the relevant electron emitting element is used as it is. On the other hand, when the electron emitting portion 207 does not have a normal characteristic, the thermally cut-off portion 191 of that electron emitting element is first heated so as to burn out or cut off the electrical connection therebetween, and the thermally connecting member 192 is then heated so as to electrically connect the element electrode 205 and the voltage supply electrode 193.

The above two heating steps may be performed at the same time or in a reversed order depending on cases. The heating can be made as local heating by using a laser source as explained above with reference to FIG. 3H (Step-9).

After the heating steps, the 'forming' voltage is applied again between the voltage supply electrodes 193 and 194 to form an electron emitting portion 210 (FIG. 19) in the electron emitting portion forming thin film 206.

Figure 19:
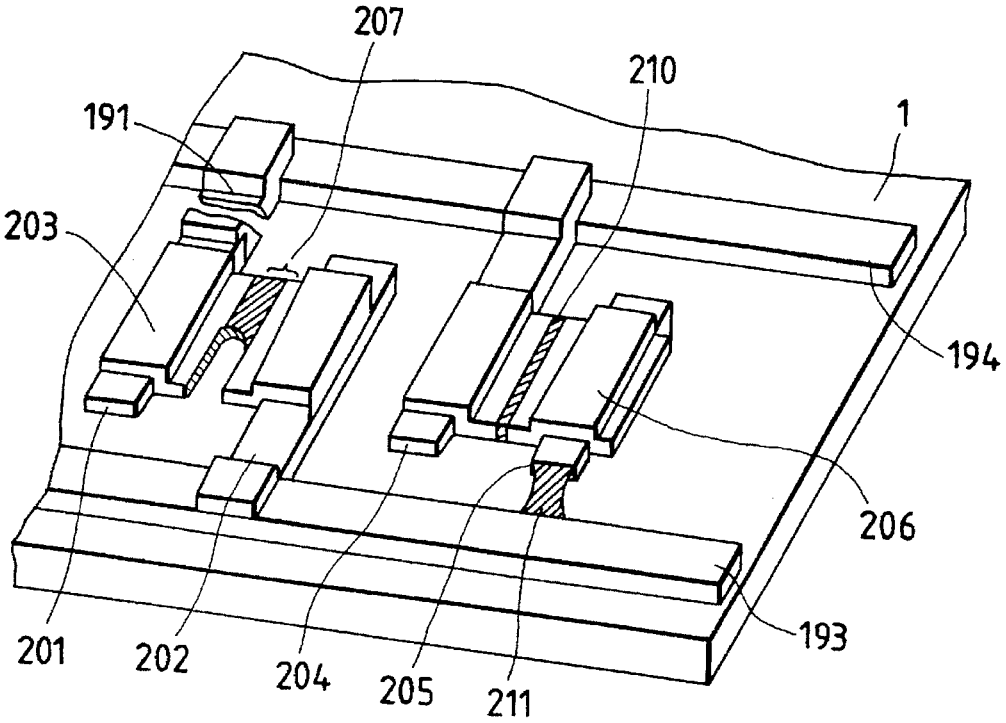
FIG. 19 is a perspective view showing an example in which an electron emitting portion is formed by subjecting a portion B of the electron emitting element of surface conduction type shown in FIG. 18 to 'forming'.

An electron emitting element of surface conduction type thus fabricated is shown in FIG. 19. Denoted by 211 is a conductive path created by heating and melting the thermally connecting member 192.

It is desired that the newly formed electron emitting portion 210 is also checked for its electron emission characteristic. If the electron emitting portion 210 also does not have a normal characteristic although this rarely happens in terms of probability, the relevant element is not used. But if a failed portion can be repaired, that element is used after repairing it. If a failed portion is difficult to restore by repair, it is preferable to reuse that element as raw material from the standpoint of effective utilization of resources.

Figure 20:
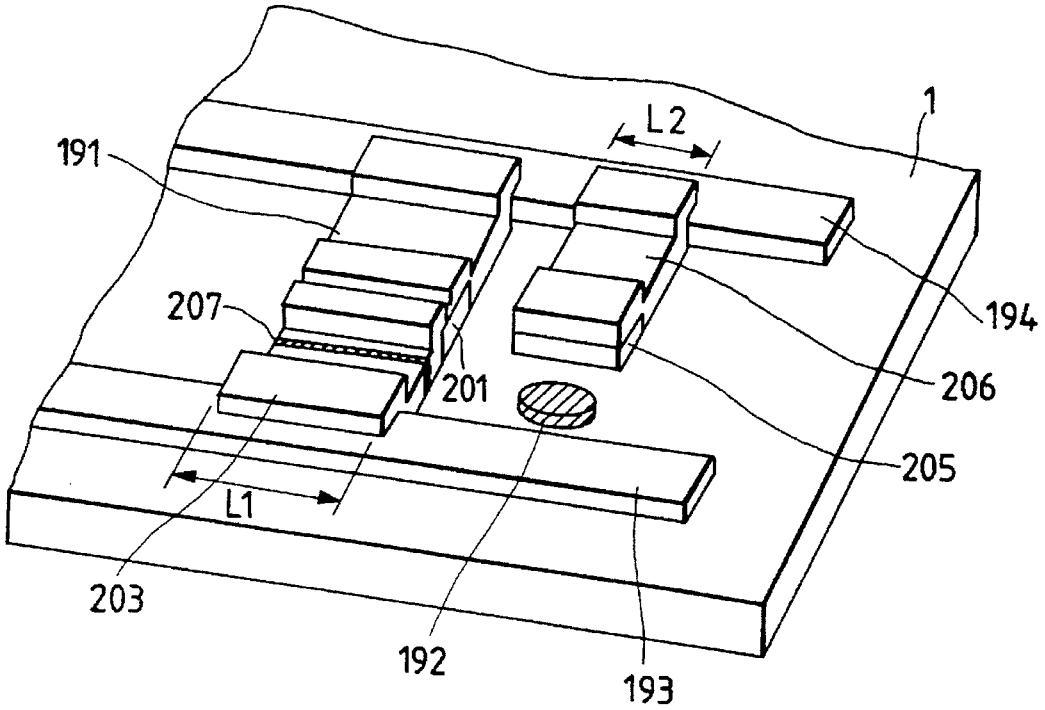
FIG. 20 is a perspective view showing another configuration of the electron emitting element of surface conduction type shown in FIG. 17.

The element schematically shown in FIG. 17 is not limited to that shown in FIGS. 18 and 19, but it may be configured as shown in FIG. 20.

In a modified embodiment of FIG. 20, rather than using the element electrodes 202 and 204 used in the element of FIG. 18, the voltage supply electrodes 193 and 194 are arranged to double as those element electrodes. Also, in this embodiment, a width L1 of the electron emitting portion forming thin film 203 (hence the electron emitting portion 207) is set to be different from a width L2 of the electron emitting portion forming thin film 206. This arrangement represents an idea for reducing an area occupied by each element and arraying multiple elements at a smaller pitch. In general, when the element is driven with a constant voltage, there exists a proportional relationship between a width of the electron emitting portion and an emission current. Accordingly, in the case where the electron emitting portion 207 is failed and the side of the electron emitting portion forming thin film 206 is used, the magnitude of a drive voltage or the duration of a drive pulse is properly modified so that each electron beam is emitted with the same intensity or in the same amount of electric charges.

Further, the thermally cut-off portion used in this embodiment may be given by a part of the electron emitting portion forming thin film, as explained above in connection with the embodiment of FIG. 8 according to the first aspect of the present invention.

Figure 21:
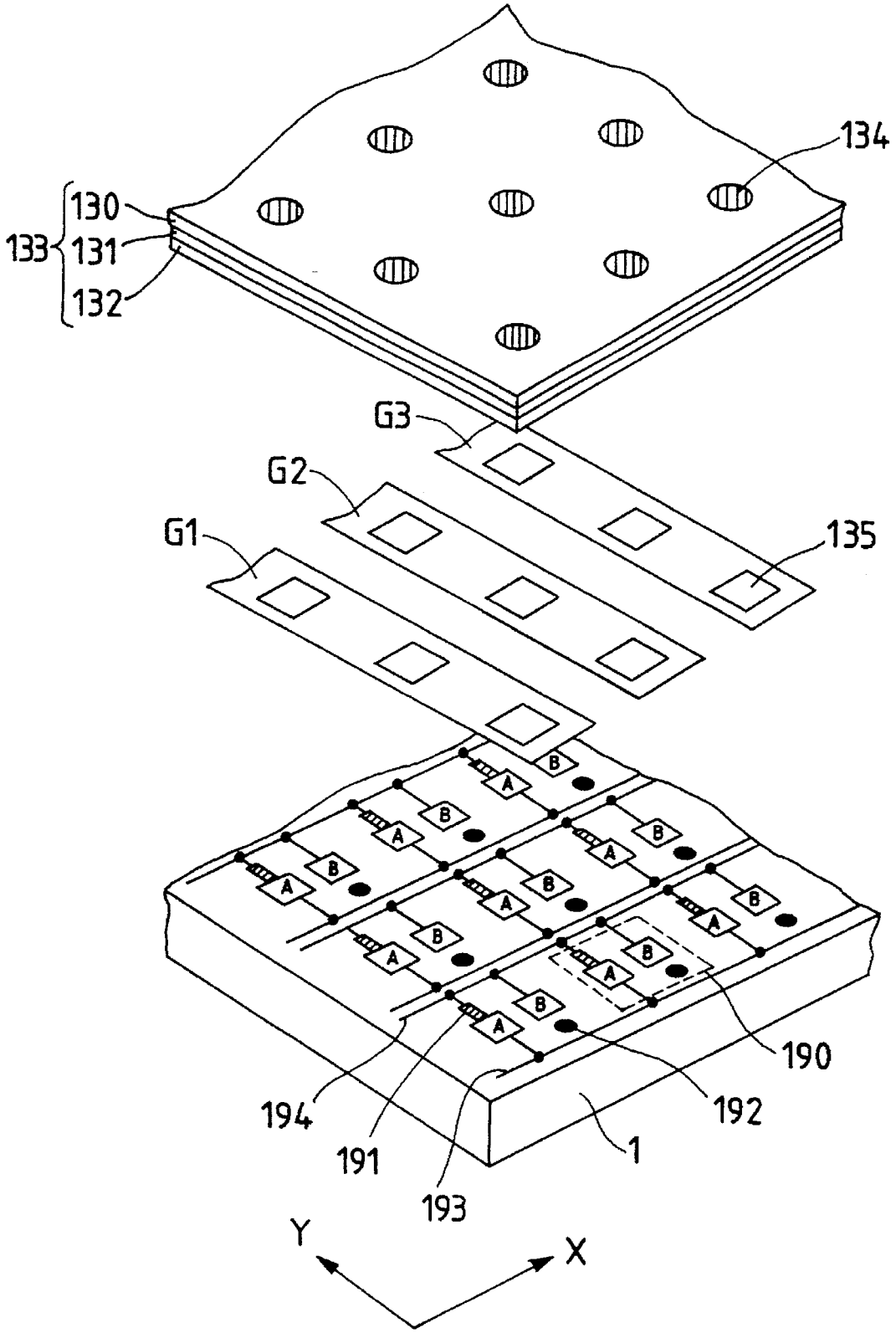
FIG. 21 is a schematic view of a display using the electron sources shown in FIG. 17.

FIG. 21 shows one example of a display panel using the electron source of Embodiment 6.

This display panel is basically constructed by replacing the electron source in the display panel of FIG. 11 with the electron source of FIG. 17, and a face plate 133, grid electrodes G1, G2, G3, . . . , etc. are the same as those shown in FIG. 11. Therefore, a detailed description of the components will not be repeated here.

A driver circuit for the display panel is also basically of the same configuration as that shown in FIG. 12. However, the element information memory 143 stores for each element which one of the portion A and the portion B is used, and the modification calculator 144 executes calculations for modifying the luminance signal in accordance with a difference in electron emission characteristic between the portions A and B.

(Embodiment 7)

Figure 22:
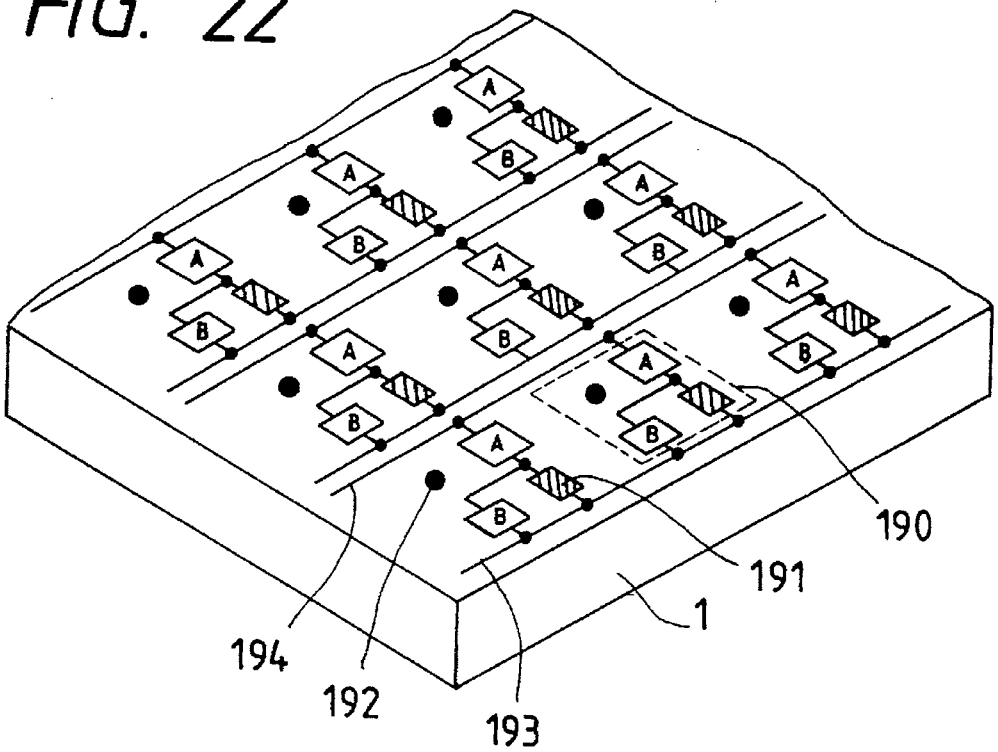
FIG. 22 is a schematic view for explaining another embodiment of the electron source according to the second aspect of the present invention.

FIG. 22 schematically shows another embodiment according to the second aspect of the present invention.

In this embodiment, a thermally cut-off portion 191 and the portion A are provided electrically in series between voltage supply electrodes 193 and 194, and the portion B is provided in parallel to the thermally cut-off portion 191. Also, a thermally connecting member 192 is provided between the portion B and the voltage supply electrode 194. An area 190 defined by dotted lines represents one of numerous electron emitting elements of surface conduction type.

In this embodiment, too, the 'forming' voltage is first applied between the voltage supply electrodes 193 and 194 so that the portion A is subjected to the electrification 'forming' to form an electron emitting portion therein. At this time, because the thermally cut-off portion 191 has electric resistance much smaller than the portion B, virtually no current flows through the portion B and hence the portion B is not subjected to the 'forming'.

Then, as with above Embodiment 6, an electron emission characteristic of the electron emitting portion formed in the portion A is checked. When the characteristic is normal, that electron emitting portion is used as it is. On the other hand, when the characteristic is not normal, the thermally cut-off portion 191 is heated so as to burn out or cut off the electrical connection therebetween, and the thermally connecting member 192 is heated so as to electrically connect the voltage supply electrode 194 and the portion B. After that, the 'forming' voltage is applied between the voltage supply electrodes 193 and 194 again to form an electron emitting portion in the portion B.

Figure 23:
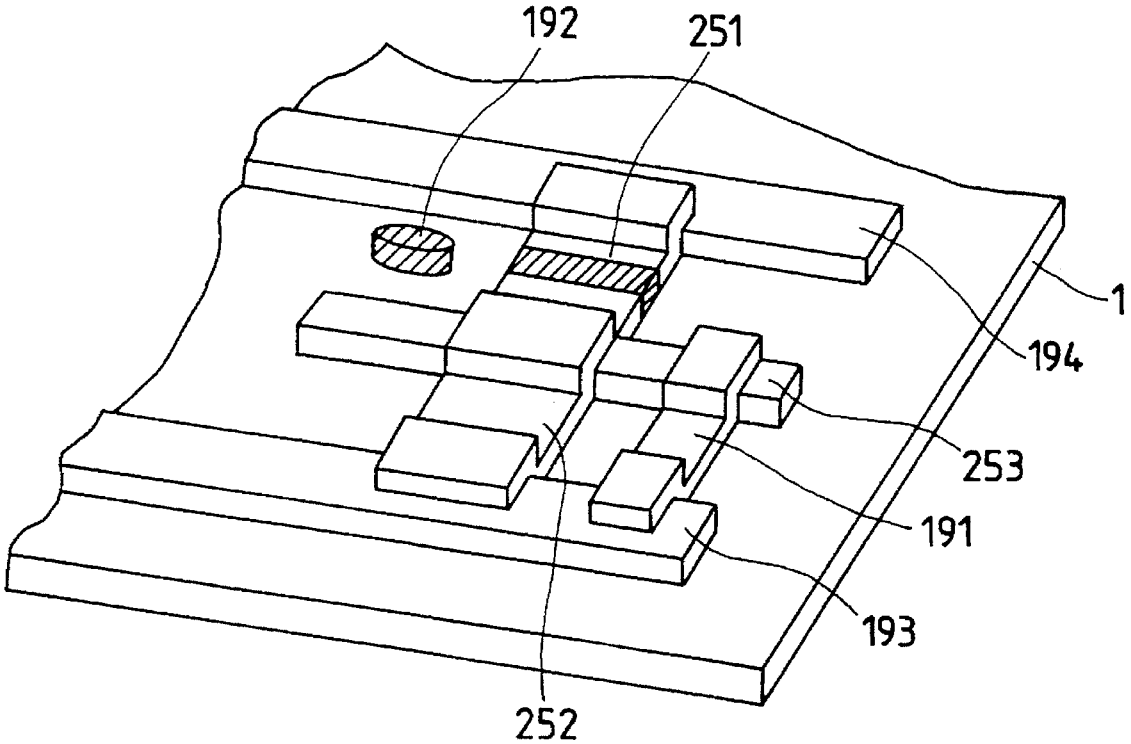
FIG. 23 is a perspective view showing one practical configuration of an electron emitting element of surface conduction type shown in FIG. 22.

FIG. 23 is a perspective view of one electron emitting element of surface conduction type, showing a practical example of the electron emitting element of surface conduction type schematically shown in FIG. 22.

In FIG. 23, denoted by 251 is an electron emitting portion forming thin film in the portion A, 252 is an electron emitting portion forming thin film in the portion B, and 253 is an element electrode.

In this example, the voltage supply electrode 194 serves also as one of element electrodes for the portion A and, similarly, the voltage supply electrode 193 serves also as one of element electrodes for the portion B. Further, the element electrode 253 serves as the other one of the element electrodes for each of the portions A and B. Additionally, in this example, the electron emitting portion forming thin films 251 and 252 can be a continuous thin film formed to straddle over the element electrode 253, as shown.

(Embodiment 8)

Figure 24:
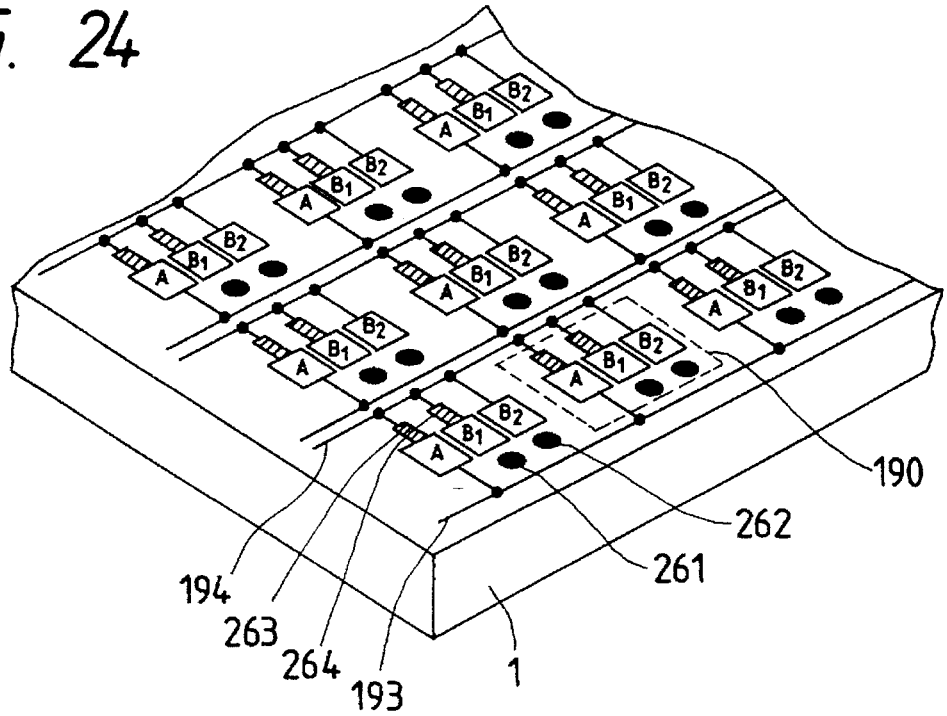
FIG. 24 is a schematic view for explaining still another embodiment of the electron source according to the second aspect of the present invention.

FIG. 24 schematically shows still another embodiment according to the second aspect of the present invention.

Each electron emitting element of surface conduction type, denoted by 190, in this embodiment includes one portion A, portions B1 and B2, thermally cut-off portions 263, 264, and thermally connecting portions 261, 262.

In this embodiment, the 'forming' voltage is first applied between the voltage supply electrodes 193 and 194 to form an electron emitting portion in the portion A.

After that, an electron emission characteristic of the formed electron emitting portion is checked. When the characteristic is normal, that electron emitting portion is used as it is. On the other hand, when the characteristic is not normal, the thermally cut-off portion 263 is heated so as to burn out or cut off the electrical connection therebetween, and the thermally connecting member 261 is heated so as to electrically connect the portion B1 and the voltage supply electrode 193.

The 'forming' voltage is then applied between the voltage supply electrodes 193 and 194 again to form an electron emitting portion in the portion B1.

Thereafter, an electron emission characteristic of the electron emitting portion formed in the portion B1 is checked. When the characteristic is normal, the relevant element is used in that condition. On the other hand, when the characteristic is not normal, the thermally cut-off portion 264 is heated so as to burn out or cut off the electrical connection therebetween, and the thermally connecting member 262 is heated so as to electrically connect the portion B2 and the voltage supply electrode 193.

As described above, with the provision of the two spare portions B1 and B2, the electron emitting elements of this embodiment can be produced at a yield almost close to 100%.

(Embodiment 9)

Figure 25:
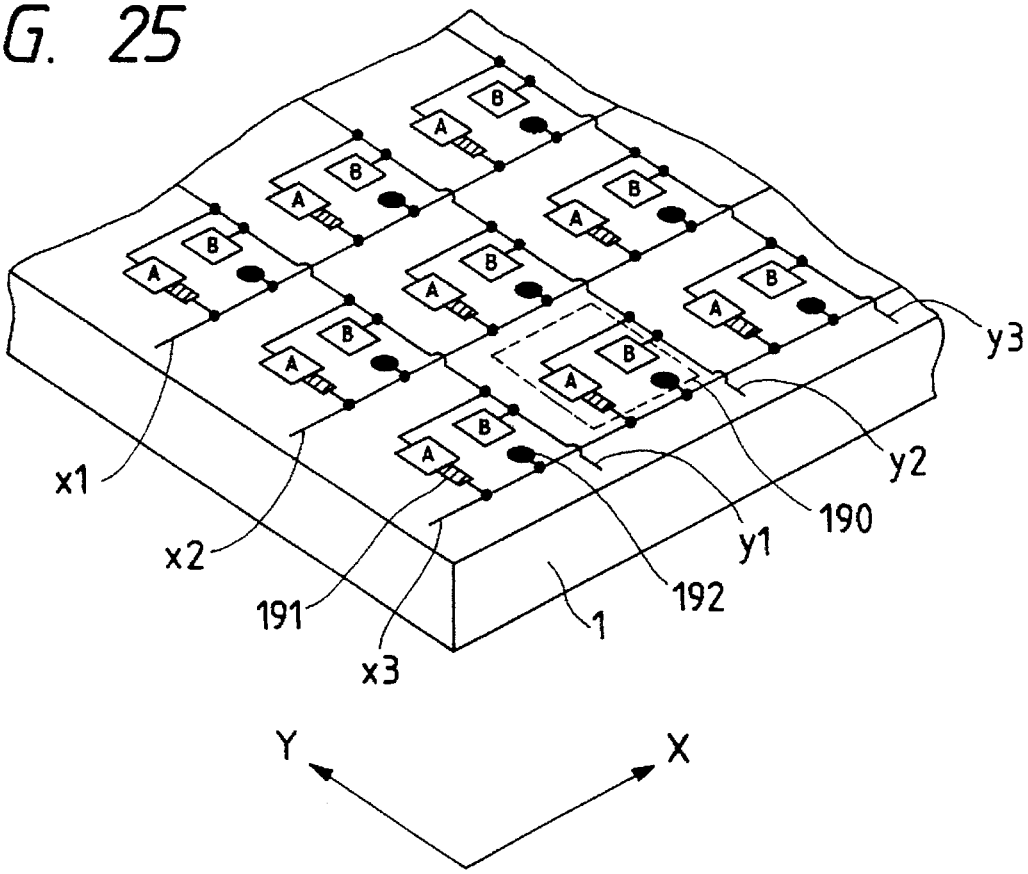
FIG. 25 is a schematic view for explaining still another embodiment of the electron source according to the second aspect of the present invention.

As shown in FIG. 25, the electron emitting elements of surface conduction type according to the second aspect of the present invention can also be connected into a simple matrix.

In FIG. 25, x1, x2, x3, . . . are each a voltage supply electrode for interconnecting those ones of the electron emitting elements of surface conduction type formed on the base plate 1 which are arrayed as one row in the X direction, whereas y1, y2, y3, . . . are each a voltage supply electrode for interconnecting those ones of the electron emitting elements of surface conduction type which are arrayed as one column in the Y direction. It is readily apparent that the electron source of FIG. 25 can be used, for example, to replace the electron source of the display shown in FIG. 15.

[Advantages]

The present invention has been described hereinabove in connection with the preferred embodiments. According to the first aspect of the present invention, a plurality of electron emitting portion forming thin films are provided in parallel electrically, and electron emitting portions are formed in these thin films. For each electron emitting element of surface conduction type, by way of example, a plurality of electron emitting portion forming thin films are provided in parallel electrically and then subjected to the electrification 'forming' to form electron emitting portions respectively in the electron emitting portion forming thin films. Electron emission characteristics of the formed electron emitting portions are then checked. For those electron emitting portions having characteristics that are not normal, the electrical connection is cut off completely to disable application of drive signals to those electron emitting portions. Further, a modulation signal is modified in accordance with the number of normal electron emitting portion in each element.

With such an arrangement, a production yield can drastically be improved in comparison with a prior art electron source which includes one electron emitting portion for each electron emitting element. Also, since an electron beam power is modified, an image can be displayed at luminance with high fidelity to an original image signal when applied to a display, for example, even if a part of the electron emitting portions fails.

According to the second aspect of the present invention, a plurality of electron emitting portion forming thin films are provided beforehand for each electron emitting element, at least one of those thin films is electrically connected to a voltage supply electrode through a thermally cut-off portion, and at least other one of those thin films is kept not electrically connected to the voltage supply electrode. An electron emitting portion is then formed in the electron emitting portion forming thin film electrically connected. In the case of an electron emitting element of surface conduction type, for example, the electron emitting portion forming thin film electrically connected is subjected to the electrification 'forming' through the voltage supply electrode to form an electron emitting portion. After that, a characteristic of the formed electron emitting portion is checked. For the electron emitting portion having a characteristic that is not normal, the electrical connection is cut off completely by heating the thermally cut-off portion to disable application of a drive signal. In addition, the electron emitting portion forming thin film not yet electrically connected is now connected to the voltage supply electrode for forming an electron emitting portion in a like manner to the above. Accordingly, even if a good electron emitting portion is not formed in the first electron emitting portion forming thin film, another electron emitting portion can be separately formed in the electron emitting portion forming thin film which has not yet been electrically connected.

With such an arrangement, a production yield of electron sources can drastically improved.

The spare electron emitting portion forming thin film which has been kept not connected initially is not necessarily required to be of the same shape as the electron emitting portion forming thin film which has been connected initially. By fabricating the spare electron emitting portion forming thin film in a smaller area, for example, an area occupied by one element can be reduced and an array pitch of elements can be made finer. Even in the case of using the spare electron emitting portion forming thin film, an electron beam can be produced with the same power by providing a driving modification means adapted to modify a difference in electron emission characteristic due to different sizes. As a result, the present electron source can display an image with high fidelity to an original image signal and with no unevenness in luminance, for example, when applied to a display.

Thus, according to the present invention, since a production yield of electron emitting elements, particularly electron emitting elements of surface conduction type, can be improved remarkably, an electron source having the same number of elements can be provided at a cheaper cost, and an electron source having the larger number of elements can easily be manufactured. It is therefore possible to realize, for example, a large-screen display comprising the increased number of pixels at a lower cost. The image forming device of the present invention having such advantages can widely be applied to not only high-quality TV set and computer terminals, but also to various domestic and industrial equipment such as large-screen home theaters, TV conference systems, and TV telephones.

What is claimed is:

1. An electron source comprising a base plate and an electron emitting element disposed on said base plate, wherein:

said electron emitting element includes a plurality of electron emitting portions electrically connected in parallel through a wire, said wire being connected to each of said electron emitting portions via a thermally activated connection cut-off member that is eradicated upon being heated.

2. An electron source according to claim 1, wherein said electron emitting element is arranged such that a plurality of conductive films including electron emitting portions are electrically connected in parallel between electrodes, said electrodes and said conductive films being connected through the thermally activated connection cut-off members.

3. An electron source according to claim 1, wherein said electron emitting element is a surface conduction electron emitting element.

4. An electron source according to claim 1, wherein said electron emitting element is disposed plural in number on said base plate.

5. An electron source according to claim 1, wherein said source includes means for modifying a drive signal applied to said electron emitting element depending on the number of said electron emitting portions.

6. An electron source according to claim 1, wherein said electron emitting element includes plural electron emitting segments, and means for modifying drive signals applied to said electron emitting segments depending on the number of the electron emitting portions in each of said electron emitting segments.

7. An electron source according to claim 1, wherein said source includes memory means for storing the number of the electron emitting portions electrically connected to said wire in said electron emitting element, and means for modifying a drive signal applied to said electron emitting element in accordance with the information stored in said memory means.

8. An electron source according to claim 1, wherein said source includes said electron emitting element plural in number, memory means for storing the number of the electron emitting portions electrically connected to said wire in each of said electron emitting elements, and means for modifying drive signals applied to said electron emitting elements per element in accordance with the information stored in said memory means.

9. An image forming device comprising an electron source according to any one of claims 1–8, an image forming member for producing an image upon irradiation of an electron beam emitted from said electron source, and modulation means for modulating said electron beam irradiated to said image forming member in accordance with an input image signal.

10. An electron source according to claim 1, wherein a scattering preventive member is provided between said thermally activated connection cut-off members.

11. An electron source according to claim 1, wherein each of said thermally activated connection cut-off members has a notched portion.

12. An electron source comprising a base plate and an electron emitting element disposed on said base plate, wherein:

said electron emitting element includes an electron emitting portion connected to voltage supply means through a wire, said wire being connected to the electron emitting portion via a thermally activated connection cut-off member that is eradicated upon being heated, and an electron emitting portion forming film with a thermally activated connecting member that forms a connection between the electron emitting portion forming film and the voltage supply means upon being heated.

13. An electron source according to claim 12, wherein said electron emitting element includes, between electrodes, a conductive film connected to said electrodes through said thermally activated connection cut-off member and including said electron emitting portions, and said electron emitting portion forming film with said thermally activated connecting member.

14. An electron source according to claim 13, wherein said thermally activated connecting member is disposed between one of said electrodes and said electron emitting portion forming film.

15. An electron source according to claim 12, wherein said electron emitting element is a surface conduction electron emitting element.

16. An electron source according to claim 12, wherein said electron emitting element is disposed plural in number on said base plate.

17. An electron source according to claim 12, wherein said source includes means for modifying a drive signal applied to said electron emitting element in accordance with an electron emission characteristic of said electron emitting element.

18. An electron source according to claim 12, wherein said source includes said electron emitting element plural in number, and means for modifying drive signals applied to said electron emitting elements per element in accordance with differences in electron emission characteristics of said electron emitting elements.

19. An image forming device comprising an electron source according to any one of claims 12 to 18, an image forming member for producing an image upon irradiation of an electron beam emitted from said electron source, and modulation means for modulating said electron beam irradiated to said image forming member in accordance with an input image signal.

20. A manufacture method for an electron source comprising a base plate and an electron emitting element disposed on said base plate, comprising the steps of:

forming a plurality of electron emitting portions electrically connected in parallel through a wire, said wire being connected to each of said electron emitting portions via a thermally activated connection cut-off member that is eradicated upon being heated, on said base plate, checking said plurality of electron emitting portions to detect electron emission characteristics, and cutting off, by heating said thermally activated connection cut-off member, said electrical connection in that electron emitting portion on which said electron emission characteristic has been found not normal as a result of said checking step.

21. A manufacture method for an electron source according to claim 20, wherein said step of forming said electron emitting portions includes a step of subjecting electron emitting portion forming films to an electrification process.

22. A manufacture method for an image forming device comprising an electron source, an image forming member for producing an image upon irradiation of an electron beam emitted from said electron source, and modulation means for modulating said electron beam irradiated to said image forming member in accordance with an input image signal, wherein said electron source is fabricated by said manufacture method according to claim 20 or 21.

23. A manufacture method for an electron source according to claim 20, wherein said step of forming said electron emitting portion includes a step of subjecting said electron emitting portion forming film to an electrification process.

24. A manufacture method for an electron source comprising a base plate and an electron emitting element disposed on said base plate, comprising the steps of:

forming an electron emitting portion connected to voltage supply means through a wire, said wire being connected to said electron emitting portion via a thermally activated connection cut-off member that is eradicated upon being heated, forming an electron emitting portion forming film with a thermally activated connecting member that forms a connection between said electron emitting portion forming film and said voltage supply means upon being heated on said base plate, checking said electron emitting portion to detect an electron emission characteristic, cutting off, by heating said thermally activated connection cut-off member, said connection in that electron emitting portion on which said electron emission characteristic has been found not normal as a result of said checking step, connecting, by heating said thermally activated connecting member, said electron emitting portion forming film to said voltage supply means, and forming an electron emitting portion in said electron emitting portion forming film.

25. A manufacture method for an image forming device comprising an electron source, an image forming member for producing an image upon irradiation of an electron beam emitted from said electron source, and modulation means for modulating said electron beam irradiated to said image forming member in accordance with an input image signal, wherein said electron source is fabricated by said manufacture method according to claim 24 or 23.

26. A repairing method for an electron source comprising a base plate and an electron emitting element disposed on said base plate, said electron emitting element having a plurality of electron emitting portions electrically connected in parallel through a wire, said wire being connected to each of said electron emitting portions via a thermally activated connection cut-off member that is eradicated upon being heated, comprising the steps of:

checking said plurality of electron emitting portions to detect an electron emission characteristic which is not normal; and cutting off, by heating said thermally activated connection cut-off member, the electrical connection of the electron emitting portion of which the electron emission characteristic has been found to be not normal as a result of said checking step.

27. A repairing method according to claim 26, wherein said plurality of electron emitting portions are formed by subjecting electron emitting portion forming films to an electrification process.

28. A repairing method for an image forming device comprising an election source, an image forming member for producing an image upon irradiation of an electron beam emitted from said electron source, and modulation means for modulating said electron beam irradiated to said image forming member in accordance with an input image signal, wherein said electron source is repaired by the repairing method according to claim 26 or claim 27.

29. A repairing method for an electron source comprising a base plate and an electron emitting element disposed on said base plate, said electron emitting element having an electron emitting portion connected to voltage supply means through a wire, said wire being connected to said electron emitting portion via a thermally activated connection cut-off member that is eradicated upon being heated, and an electron emitting portion forming film with a thermally activated connecting member that forms a connection between said electron emitting portion forming film and said voltage supply means upon being heated, comprising the steps of:

checking said electron emitting portion to detect an electron emission characteristic which is not normal;

cutting off by heating said thermally activated connection cut-off member, the electrical connection of the electron emitting portion of which the electron emission characteristic has been found to be not normal as a result of said checking step;

connecting, by heating said thermally activated connecting member, said electron emitting portion forming film to said voltage supply means; and forming an electron emitting portion in said electron emitting portion forming film.

30. A repairing method according to claim 29, wherein said electron emitting portion is formed by subjecting an electron emitting portion forming film to an electrification process.

31. A repairing method for an image forming device comprising an electron source, an image forming member for producing an image upon irradiation of an electron beam emitted from said electron source, and modulation means for modulating said electron beam irradiated to said image forming member in accordance with an input image signal, wherein said electron source is repaired by the repairing method according to claim 29 or claim 30.

* * * * *

UNITED STATES PATENT AND TRADEMARK OFFICE

CERTIFICATE OF CORRECTION

PATENT NO. : 5,650,795

DATED : July 22, 1997

INVENTOR(S) : BANNO ET AL.

It is certified that error appears in the above-identified patent and that said Letters Patent is hereby corrected as shown below: TITLE PAGE:

At [56] References Cited

U.S. PATENT DOCUMENTS

Insert:

--4,904,895 2/1990 Tsukamoto et al.
4,956,578 9/1990 Shimizu et al.
5,023,110 6/1991 Nomura et al.
5,066,883 11/1991 Yoshioka et al.
5,155,416 10/1992 Suzuki et al.
4,857,161 8/1989 Michel Borel et al.
5,136,205 8/1992 Sokolich et al.--

At [56] References Cited

FOREIGN PATENT DOCUMENTS

Insert:

--Sept. 26, 1990 [EP] EPA 03-88984A3
Jan. 23, 1989 [JP] Japan 1-19655
Feb. 1, 1989 [JP] Japan 64-31332
Feb. 26, 1990 [JP] Japan 90-056822--

UNITED STATES PATENT AND TRADEMARK OFFICE

CERTIFICATE OF CORRECTION

PATENT NO. : 5,650,795

DATED : July 22, 1997

INVENTOR(S) : BANNO ET AL.

It is certified that error appears in the above-identified patent and that said Letters Patent is hereby corrected as shown below:

At [56] References Cited

OTHER PUBLICATIONS

Insert:

--Mead, C.A., "Operation of Tunnel-Emission Devices," Journal of Applied Physics, Vol. 32, January-December 1961, pgs. 646-652.

Dittmer, G., "Electron Conduction and Electron Emission of Discontinuous Thin Films," Thin Solid Films-Elsevier Sequoia S.A. Lausanne-Switzerland 9 (1972) pages 317-328.

Spindt et al., "Physical properties of thin-film field emission cathodes with molybdenum cones," Journal of Applied Physics, December 1976, Vol. 47, No. 12, pgs. 5248-5263.

Schiller et al., "Electron-Beam Trimming of Thin and Thick Film Resistor Networks," SOLID STATE TECHNOLOGY, July, 1975, Vol. 18, No. 7, pgs. 38-44.--

UNITED STATES PATENT AND TRADEMARK OFFICE

CERTIFICATE OF CORRECTION

PATENT NO. : 5,650,795

DATED : July 22, 1997

INVENTOR(S) : BANNO ET AL.

It is certified that error appears in the above-identified patent and that said Letters Patent is hereby corrected as shown below:

At [56] References Cited

OTHER PUBLICATIONS (Cont.)

Insert:

--Hartwell et al., "Strong Electron Emission From Patterned Tin-Indium Oxide Thin Films," IEE Technical Digest 1975, Int'l Electron Devices Meeting, December 1-3, 1975 Washington, DC, pgs. 519-521.

Araki et al., "Electroforming and Electron Emission of Carbon Thin Films," Journal of the Vacuum Society of Japan, Vol. 26, No. 1, pgs. 22-29.

Dyke et al., "Field Emission," Advances in Electronics and Electron Physics, Vol. VIII, 1956, Academic Press Inc., New York, NY, pgs. 89-185.

Elinson et al., "The Emission of Hot Electrons And The Field Emission of Electrons From Tin Oxide, Radio Engineering & Electronic Physics, Vol. 7, July 1965, pgs. 1290-1296.

UNITED STATES PATENT AND TRADEMARK OFFICE

CERTIFICATE OF CORRECTION

PATENT NO. : 5,650,795

DATED : July 22, 1997

INVENTOR(S) : BANNO ET AL.

It is certified that error appears in the above-identified patent and that said Letters Patent is hereby corrected as shown below:

Column 8

Line 36, "nine" should read --nine of--.

Column 9

Line 63, "[Step-5]" should read --(Step-5)--.

Column 12

Line 38, "connection" should read --connection of--; and
Line 52, "limited" should read --limited to--.

Column 17

Line 21, "prising" should read --prises--.

Column 18

Line 4, "204,205" should read --204, 205--; and
Line 17, "in" should read --to--.

UNITED STATES PATENT AND TRADEMARK OFFICE

CERTIFICATE OF CORRECTION

PATENT NO. : 5,650,795

DATED : July 22, 1997

INVENTOR(S) : BANNO ET AL.

It is certified that error appears in the above-identified patent and that said Letters Patent is hereby corrected as shown below:

Column 21

Line 51, "can" should read --can be--.

Column 22

Line 62, "claims 1-8," should read --claims 1,2,4 to 8,--

Signed and Sealed this

Fourteenth Day of April, 1998

Bruce Lehman

*Attest:*

BRUCE LEHMAN

*Attesting Officer*

*Commissioner of Patents and Trademarks*